US007744198B2

(12) United States Patent
Iwao

(10) Patent No.: US 7,744,198 B2
(45) Date of Patent: Jun. 29, 2010

(54) INKJET HEAD PRINTING DEVICE

(75) Inventor: Naoto Iwao, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 340 days.

(21) Appl. No.: 10/913,534

(22) Filed: Aug. 9, 2004

(65) Prior Publication Data

US 2005/0073537 A1 Apr. 7, 2005

(30) Foreign Application Priority Data

Aug. 14, 2003 (JP) ..... 2003-293540

(51) Int. Cl.
*B41J 2/045* (2006.01)

(52) U.S. Cl. ..... 347/70; 347/68; 347/69

(58) Field of Classification Search ..... 347/10–11, 347/69, 70, 5, 9, 68
See application file for complete search history.

(56) References Cited

U.S. PATENT DOCUMENTS

| | | | | |
|---|---|---|---|---|
| 4,251,823 | A | 2/1981 | Sagae | |
| 5,266,965 | A | 11/1993 | Komai et al. | |
| 5,402,159 | A | 3/1995 | Takahashi et al. | |
| 5,801,732 | A | 9/1998 | Pengelly | |
| 6,033,059 | A | 3/2000 | Wen et al. | |
| 6,053,596 | A * | 4/2000 | Nakano et al. | 347/15 |
| 6,352,335 | B1 * | 3/2002 | Koyama et al. | 347/37 |
| 6,412,925 | B1 * | 7/2002 | Takahashi | 347/69 |
| 6,808,254 | B2 | 10/2004 | Sajauda et al. | |
| 2002/0080215 | A1 * | 6/2002 | Sakaida et al. | 347/71 |
| 2003/0103115 | A1 * | 6/2003 | Watanabe et al. | 347/68 |
| 2003/0156156 | A1 * | 8/2003 | Sakaida et al. | 347/47 |
| 2004/0119790 | A1 * | 6/2004 | Taira | 347/68 |

FOREIGN PATENT DOCUMENTS

| | | | |
|---|---|---|---|
| EP | 0 936 069 | A2 | 8/1999 |
| EP | 0 943 439 | A2 | 9/1999 |
| EP | 1153753 | A1 * | 11/2001 |
| EP | 1 316 427 | A1 | 6/2003 |
| JP | A 55-034906 | | 3/1980 |
| JP | A 4-341852 | | 11/1992 |
| JP | A 05-069544 | | 3/1993 |
| JP | A-06-143589 | | 5/1994 |
| JP | A 10-315451 | | 12/1998 |
| JP | A 11-291498 | | 10/1999 |
| JP | A 11-314362 | | 11/1999 |
| JP | A 2002-103604 | | 4/2002 |
| JP | A-2002-166543 | | 6/2002 |
| JP | A 2003-165215 | | 6/2003 |

* cited by examiner

*Primary Examiner*—Lam S Nguyen
(74) *Attorney, Agent, or Firm*—Oliff & Berridge, PLC

(57) ABSTRACT

There is provided an inkjet head printing device, which includes an inkjet head that has an ink flow channel unit including a plurality of nozzles for ejecting ink and a plurality of pressure chambers respectively provided for the plurality of nozzles, and has a piezoelectric actuator unit including a plurality of electrodes. The inkjet head further includes a pulse controller that generates a plurality of types of ejection pulse patterns having different phases and drives the plurality of electrodes corresponding to the plurality of nozzles which are to eject the ink using the plurality of types of ejection pulse patterns.

20 Claims, 18 Drawing Sheets

INKJET HEAD PRINTING DEVICE

BACKGROUND OF THE INVENTION

The present invention relates to an inkjet head printing device such as an inkjet printer having an inkjet head for ejecting ink to a recording medium.

The inkjet head printing devices have been widely used. Japanese Patent Provisional Publication No. HEI 4-341852 discloses one of conventional inkjet heads employed in the inkjet head printing device. The ink jet head has a fluid channel unit and an actuator unit. The fluid channel unit has a plurality of pressure chambers and a plurality of nozzles provided respectively for the plurality of pressure chambers. Ink introduced into the pressure chambers is ejected from the nozzles by applying pressure to the pressure chambers using the actuator unit. To form an image on a sheet of paper, pressure is selectively applied to the pressure chambers by the actuator unit.

The actuator unit has a laminated structure consisting of a plurality of piezoelectric sheets and a common electrode layer. Further, a plurality of small electrodes are formed respectively for the plurality of the pressure chambers on one of the piezoelectric sheets. The common electrode layer is maintained at a ground level. One of the piezoelectric sheets sandwiched between the common electrode layer and the plurality of small electrodes is used as an active layer that is distorted when voltage is applied thereto to apply presser to the pressure chambers.

If a voltage is applied between the small electrode and the common electrode, the voltage is applied to a portion of the piezoelectric sheet (i.e., the active layer) in a direction of polarization of the piezoelectric sheet. Therefore, the portion of the piezoelectric sheet expands/contracts in the direction of its thickness by a vertical piezoelectric effect, by which the volumetric capacity of the pressure chamber is changed and the ink is ejected from the nozzle.

SUMMARY OF THE INVENTION

It is desired to arrange the nozzles on the inkjet head more densely to increase resolution of the image and/or to improve printing speeds. However, if the density of the nozzles is increased, i.e., the density of the pressure chambers is increased, portions of the piezoelectric sheet (active layer) corresponding to neighboring pressure chambers, surrounding a target pressure chamber being applied with pressure, are distorted because of the dense arrangement of the pressure chambers.

Such problem is frequently called a structural crosstalk. If such a structural crosstalk occurs, the amount of ejection of ink improperly increases or decreases relative to an appropriate amount of ejection of the ink, or pressure chambers surrounding a target pressure chamber which is being applied with pressure are distorted by neighboring electrodes. Consequently, quality of the image is deteriorated.

The present invention is advantageous in that it provides an inkjet head which is capable of suppressing a structural cross talk.

According to an aspect of the invention, there is provided an inkjet head printing device including an inkjet head. The inkjet head has an ink flow channel unit including a plurality of nozzles for ejecting ink and a plurality of pressure chambers respectively provided for the plurality of nozzles, and a piezoelectric actuator unit including a plurality of electrodes which are provided to apply pressure by using an piezoelectric effect to their respective pressure chambers to eject ink from the respective ones of the plurality of nozzles. The inkjet head further includes a pulse controller that generates a plurality of types of ejection pulse patterns having different phases, and drives the plurality of electrodes corresponding to the plurality of nozzles which are to eject the ink using the plurality of types of ejection pulse patterns.

With this configuration, since the electrodes are driven by using the plurality of type of ejection pulse patterns having different phases, the structural cross talk can be suppressed.

In a particular case, the pulse controller drives the plurality of electrodes corresponding to the plurality of nozzles which are to eject the ink so that when a certain electrode of the plurality of electrodes corresponding to a certain pressure chamber of the plurality of pressure chambers is supplied with a first ejection pulse pattern of the plurality of types of ejection pulse patterns, at least one of neighboring electrodes corresponding to neighboring pressure chambers adjacent to the certain pressure chamber is supplied with one of the plurality of types of ejection pulse patterns different from the first ejection pulse pattern.

Optionally, an electrode of the neighboring electrodes corresponding to a pressure chamber of the neighboring pressure chambers located adjacently to the certain pressure chamber in a first direction of an arrangement of the plurality of pressure chambers may be supplied with one of the plurality of types of ejection pulse patterns different from the first ejection pulse pattern.

Still optionally, an electrode of the neighboring electrodes corresponding to a pressure chamber of the neighboring pressure chambers located adjacently to the certain pressure chamber in a second direction of the arrangement of the plurality of pressure chambers different from the first direction may be supplied with one of the plurality of types of ejection pulse patterns different from the first ejection pulse pattern.

In a particular case, the plurality of pressure chambers may be arranged in a plane to have a plurality rows, each of which has pressure chambers arranged in a line. In this case, electrodes of the plurality of electrodes corresponding to adjacent ones of the plurality of pressure chambers of each of the plurality of rows may be supplied with different ones of the plurality of types of the ejection pulse patterns, respectively.

In a particular case, the plurality of pressure chambers may be arranged in a plane to have a plurality rows, each of which has pressure chambers arranged in a line. In this case, one of the plurality of types of the ejection pulse patterns supplied to electrodes of the plurality of electrodes corresponding to the pressure chambers of one of the plurality of rows may be different from one of the plurality of types of the ejection pulse patterns supplied to electrodes of the plurality of electrodes corresponding to the pressure chambers of another one of the plurality of rows adjacent to the one of the plurality of rows.

Optionally, the pulse controller may drive the plurality of electrodes so that all of the neighboring electrodes corresponding to the neighboring pressure chambers adjacent to the certain pressure chamber are supplied at least one of the plurality of types of ejection pulse patterns different from the first ejection pulse pattern supplied to the certain electrode corresponding to the certain pressure chamber.

Still optionally, the pulse controller may include a pulse generator that generates the plurality of types of ejection pulse patterns based on image data, and a pulse supplying system that assigns the plurality of types of ejection pulse patterns to the plurality of electrodes to drive the plurality of electrodes.

In a particular case, the plurality of types of ejection pulse patterns generated by the pulse generator may include at least three types of ejection pulse patterns.

Optionally, the pulse supplying system may assign the at least three types of ejection pulse patterns to the plurality of electrodes in a staggered arrangement.

Alternatively, the pulse supplying system may assign a first, second and third ejection pulse patterns of the at least three types of ejection pulse patterns to the plurality of electrodes in this order in one direction of an arrangement of the plurality of electrodes.

In a particular case, the plurality of types of ejection pulse patterns generated by the pulse generator may include at least four types of ejection pulse patterns.

Optionally, the plurality of pressure chambers and the plurality of electrodes may have rhombic shapes, and may be arranged in a staggered arrangement. In this case, the pulse supplying system assigns the plurality of types of ejection pulse patterns to the plurality of electrodes such that electrodes located adjacently to a first electrode in a direction of a line passing through obtuse angle portions of the rhombic shape of the first electrode are assigned ejection pulse patterns of the four types of ejection pulse patterns different from one of the four types of ejection pulse patterns assigned to the first electrode, and that electrodes located adjacently to the first electrode in a direction of a line passing through acute angle portions of the rhombic shape of the first electrode are assigned ejection pulse patterns of the four types of ejection pulse patterns different from one of the four types of ejection pulse patterns assigned to the first electrode.

In a particular case, the pulse supplying system may include a timing determination unit that determines a number of types of ejection pulse patterns. The pulse generator generates different types of the ejection pulse patterns by the number of types of ejection pulse patterns determined by the timing determination unit.

Optionally, the timing determination unit may determine the number of types of ejection pulse patterns in accordance with a number of nozzles which are to eject the ink with respect to a number of all of the plurality of nozzles.

Still optionally, the pulse supplying system may assign the plurality of types of ejection pulse patterns to the plurality of electrodes using a supplying pattern representing a correspondence between the plurality of electrodes and the plurality of types of ejection pulse patterns.

Still optionally, the supplying pattern may be predetermined and the pulse supplying system may use the predetermined supplying pattern.

Still optionally, the pulse supplying system may include a supplying pattern determination unit that determines the supplying pattern based on the image data and a number of types of the plurality of types of ejection pulse patterns.

In a particular case, the pulse controller may include a determination unit that determines a number of types of ejection pulse patterns included in the plurality of types of ejection pulse patterns, and determines which type of the plurality of types of ejection pulse patterns is supplied to each of the plurality of electrodes, and a pulse generator that generates the plurality of types of ejection pulse patterns to drive the plurality of electrodes in accordance with a determination result of the determination unit.

In a particular case, the ink flow channel unit may include a common manifold, the plurality of pressure chambers communicate with the common manifold via respective outlets. In this case, the pulse controller drives the plurality of electrodes corresponding to the plurality of nozzles which are to eject the ink so that when a certain electrode of the plurality of electrodes corresponding to a certain outlet of a certain pressure chamber of the plurality of pressure chambers is supplied with a first ejection pulse pattern of the plurality of types of ejection pulse patterns, at least one of neighboring electrodes corresponding to pressure chambers communicating with neighboring outlets adjacent to the certain outlet of the certain pressure chamber is supplied with one of the plurality of types of ejection pulse patterns different from the first ejection pulse pattern.

Optionally, all of the neighboring electrodes may be supplied with the plurality of types of ejection pulse patterns different from the first ejection pulse pattern.

According to another aspect of the invention, there is provided a method of driving an inkjet head having an ink flow channel unit and a piezoelectric actuator unit, the ink flow channel unit including a plurality of nozzles for ejecting ink and a plurality of pressure chambers respectively provided for the plurality of nozzles, and the piezoelectric actuator unit including a plurality of electrodes which are provided to apply pressure by using an piezoelectric effect to their respective pressure chambers to eject ink from the respective ones of the plurality of nozzles. The method includes generating a plurality of types ejection pulse patterns having different phases, and supplying the plurality of types of ejection pulse patterns to the plurality of electrodes such that when a certain electrode of the plurality of electrodes corresponding to a certain pressure chamber of the plurality of pressure chambers is supplied with a first ejection pulse pattern of the plurality of types of ejection pulse patterns, at least one of neighboring electrodes corresponding to neighboring pressure chambers adjacent to the certain pressure chamber is supplied with one of the plurality of types of ejection pulse patterns different from the first ejection pulse pattern.

With this configuration, since the electrodes are driven by using the plurality of type of ejection pulse patterns having different phases, the structural cross talk can be suppressed.

Optionally, the method includes determining a number of types of ejection pulse patterns to be generated based on a number of nozzles which are to eject the ink, the number of nozzles being obtained from image data. In the generating step, different types of ejection pulse patterns are generated by the determined number of types of ejection pulse patterns.

Still optionally, in the supplying step, the plurality of types of ejection pulse patterns may be assigned to the plurality of electrodes using a supplying pattern representing a correspondence between the plurality of electrodes and the plurality of types of ejection pulse patterns.

Still optionally, the supplying step may include determining the supplying pattern based on image data and a number of types of the plurality of types of ejection pulse patterns.

According to another aspect of the invention, there is provided a computer program product for use on an inkjet head printing device including an inkjet head having an ink flow channel unit and a piezoelectric actuator unit, the ink flow channel unit including a plurality of nozzles for ejecting ink and a plurality of pressure chambers respectively provided for the plurality of nozzles, and the piezoelectric actuator unit including a plurality of electrodes which are provided to apply pressure by using an piezoelectric effect to their respective pressure chambers to eject ink from the respective ones of the plurality of nozzles. The computer program product includes instructions to generate a plurality of types ejection pulse patterns having different phases, and instructions to supply the plurality of types of ejection pulse patterns to the plurality of electrodes such that when a certain electrode of the plurality of electrodes corresponding to a certain pressure chamber of the plurality of pressure chambers is supplied with a first ejection pulse pattern of the plurality of types of ejection pulse patterns, at least one of neighboring electrodes corresponding to neighboring pressure chambers adjacent to the certain pressure chamber is supplied with one of the plurality of types of ejection pulse patterns different from the first ejection pulse pattern.

With this configuration, since the electrodes are driven by using the plurality of type of ejection pulse patterns having different phases, the structural cross talk can be suppressed.

Optionally, the computer program product may include instructions to determine a number of types of ejection pulse patterns to be generated based on a number of nozzles which are to eject the ink, the number of nozzles being obtained from image data. In this case, different types of ejection pulse patterns are generated by the determined number of types of ejection pulse patterns.

Still optionally, in the instructions to supply the plurality of types of ejection pulse patterns to the plurality of electrodes, the plurality of types of ejection pulse patterns may be assigned to the plurality of electrodes using a supplying pattern representing a correspondence between the plurality of electrodes and the plurality of types of ejection pulse patterns.

Still optionally, the computer program product may include instructions to determine the supplying pattern based on image data and a number of types of the plurality of types of ejection pulse patterns.

BRIEF DESCRIPTION OF THE ACCOMPANYING DRAWINGS

FIG. 1 schematically shows an inkjet printer;

FIG. 12A shows another example of predetermined supplying patterns used in the pulse supplying unit of the pulse control unit;

DETAILED DESCRIPTION OF THE EMBODIMENTS

First Embodiment

Figure 1:
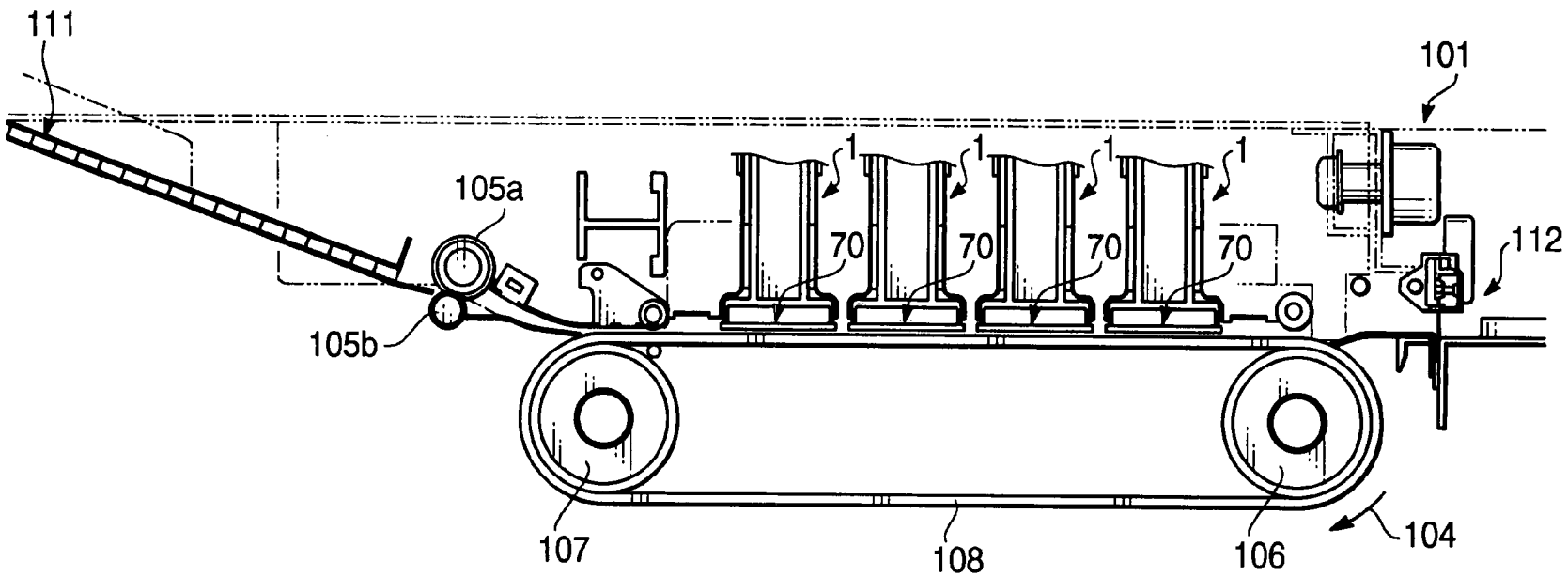

FIG. 1 schematically shows an inkjet printer 101 according to a first embodiment of the invention. As shown in FIG. 1, the inkjet printer 101 has four inkjet heads 1 for forming color images. In the inkjet printer 101, a sheet feeding unit 111 is located on an upstream side of a sheet feed path, and a sheet ejecting portion 112 is located on a downstream side of the sheet feed path. As described in detail below, the inkjet printer 101 has a control unit 113 which controls operation of the inkjet heads 1.

As shown in FIG. 1, along the sheet feed path, a pair of sheet feed rollers 105*a* and 105*b* is located immediately on the downstream side of the sheet feeding unit 111. By the pair of sheet feed rollers 105*a* and 105*b*, the sheet is fed from the sheet feeding unit 111 into the inside of the inkjet printer 101.

At a midway of the sheet feed path, a carrying belt 108 which is driven by belt rollers 106 and 107 is located. An outer surface of the carrying belt 108 has been processed by a silicon coating. Therefore, the sheet fed into the inside of the inkjet printer 101 is carried along the sheet feed path toward the downstream side by rotations of the belt roller 106 in a direction of allow 104 (see FIG. 1) while the sheet is being held on the outer surface of the carrying belt 108 by adhesive properties of the outer surface of the carrying belt 108.

Each of the inkjet heads 1 has a head body 70 having a rectangular form when it is viewed as a plan view. The inkjet heads 1 are located such that longitudinal sides thereof are substantially perpendicular to a direction of the sheet feed path, and that they are adjacent to one another. Each of the inkjet heads 1 has a bottom surface facing the sheet feed path. On the bottom surface of the inkjet head 1, a plurality of nozzles 8 for ejecting ink are formed (see FIG. 5). The four head bodies 70 eject ink having colors of magenta, yellow, cyan and black, respectively.

Each of the head bodies 70 and the carrying belt 108 are located closely to have a clearance between them. The clearance constitutes the sheet feed path. When the sheet is positioned, along the sheet feed path, immediately below each of the head bodies 70, the ink having the corresponding color is ejected from the nozzles of each head body 70 to the sheet. Consequently, a color image or a monochrome gray scale image can be formed on the sheet.

Figure 2:
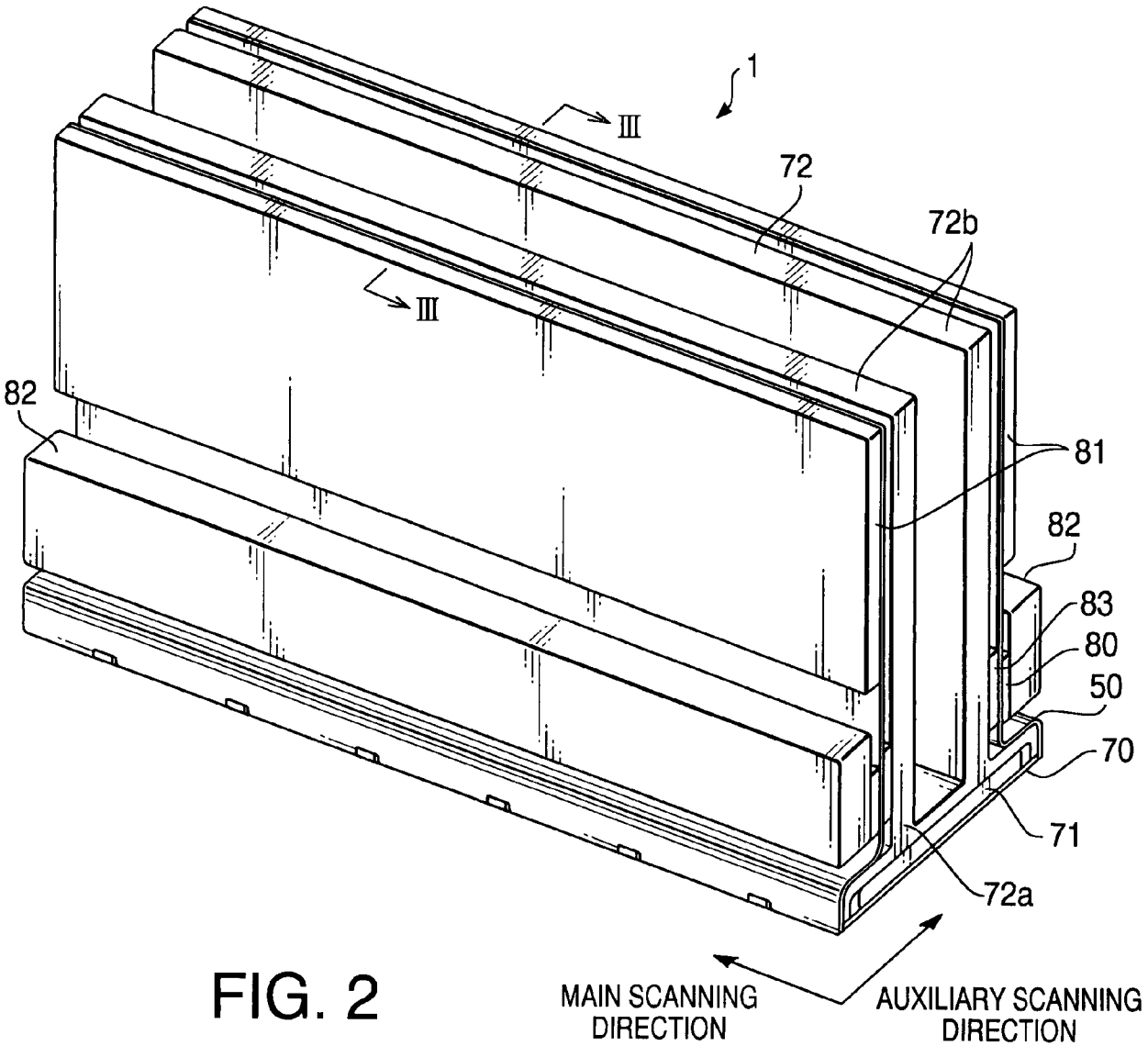
FIG. 2 is a perspective view of an inkjet head of the inkjet printer.
Figure 3:
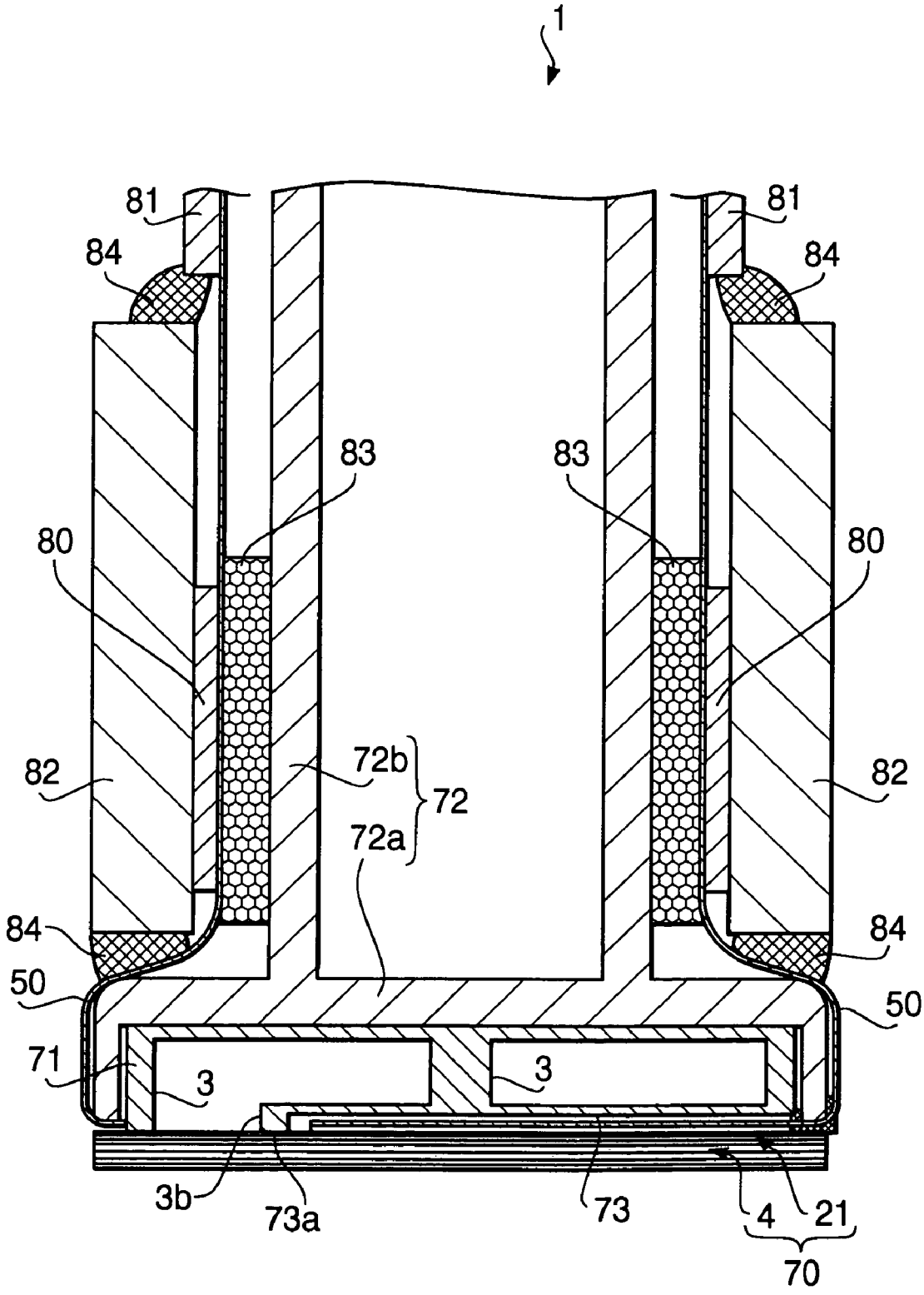
FIG. 3 is a cross sectional view of the inkjet head shown in FIG. 2.

Hereafter, a configuration of the inkjet head 1 will be described in detail. FIG. 2 is a perspective view of the inkjet head 1. FIG. 3 is a cross sectional view of the inkjet head 1 when it is cut along a line III-III indicated in FIG. 2. As shown in FIG. 2, the inkjet head 1 includes the head body 70 having the rectangular form elongated in a main scanning direction (which is perpendicular to the direction of the sheet feed path), and a base block 71 located on the top surface of the head body 70. In the base block 71, two ink reservoirs 3 are formed to supply the head body 70 with ink. Each ink reservoir 3 has a form of a box elongated along the longitudinal side of the rectangular form of the head body 70.

As described in detail later, the head body 70 has an ink flow channel unit 4 in which ink flow channels are formed, and a plurality of actuator units 21 (see FIG. 4). Each of the ink flow channel unit 4 and the actuator unit 21 has a laminated structure composed of a plurality of thin plates adhered to one another.

On an outer region of a holder 72, FPCs (flexible printed circuit) 50 are provided. Each FPC 50 is located on the outer region of the holder 72 via an elastic member 83. The FPC 50 is bent at corners of a holding portion 72*a* of the holder 72, and is inserted into a gap between the base block 71 and head body 70 to be electrically connected to each actuator unit 21.

More specifically, as shown in FIG. 3, the base block 71 has an opening 3*b*. A bottom surface 73 of the base block 71 contacts the head body 70 only at a portion 73*a* situated in the vicinity of the opening 3*b*. That is, between the top surface of the head body 70 and the bottom surface 73 except a region of the opening 3*b*, the gap is formed. Each actuator unit 21 is located in the gap.

As shown in FIG. 2, the base block 71 is adhered to a concave portion of the holding portion 72*a* of the holder 72. The holder 72 further has a pair of protrusions 72*b* arranged to have a certain interval. Each of the protrusions 72*b* has a form elongated in a direction perpendicular to a top surface of the holding portion 72*a*.

On an outer surface of the FPC 50, a driver IC 80 is mounted. The FPC 50 is soldered to the driver IC 80 and the actuator unit 21 to electrically connect the driver IC 80 to the actuator unit 21. Driving signals are transmitted from the driver IC 80 to the actuator unit 21.

Further, the inkjet head 1 has heatsinks 82. The heatsinks 82 are arranged such that an inner surface of the heatsink 82 and an outer surface of the driver IC 80 are kept in absolute contact with each other. With this structure, heat generated by the driver IC 80 is dissipated into the atmosphere. On an upper side of the heatsink 82, a printed circuit board 81 is located. The printed circuit board 81 is also mounted on the FPC 50 to be electrically connected to the driver IC 80. Further, shield members 84 are located between the printed circuit board 81 and the top surface of the heatsink 82, and between a bottom surface of the heatsink 82 and the FPC 50.

As described in detail later, circuits on the printed circuit board 81 and the driver IC 80, which are connected via the FPC 50, constitute a pulse control unit 200 (see FIG. 10) that generates pulses for driving the actuator unit 21. The pulse control unit 200 communicates with the control unit 113 so as to transmit the driving pulses to the inkjet head 1. By the above mentioned structure of each inkjet head 1, the four inkjet heads 1 emit the ink having their respective color components of magenta, yellow, cyan and black onto the sheet to form the color image.

Figure 4:
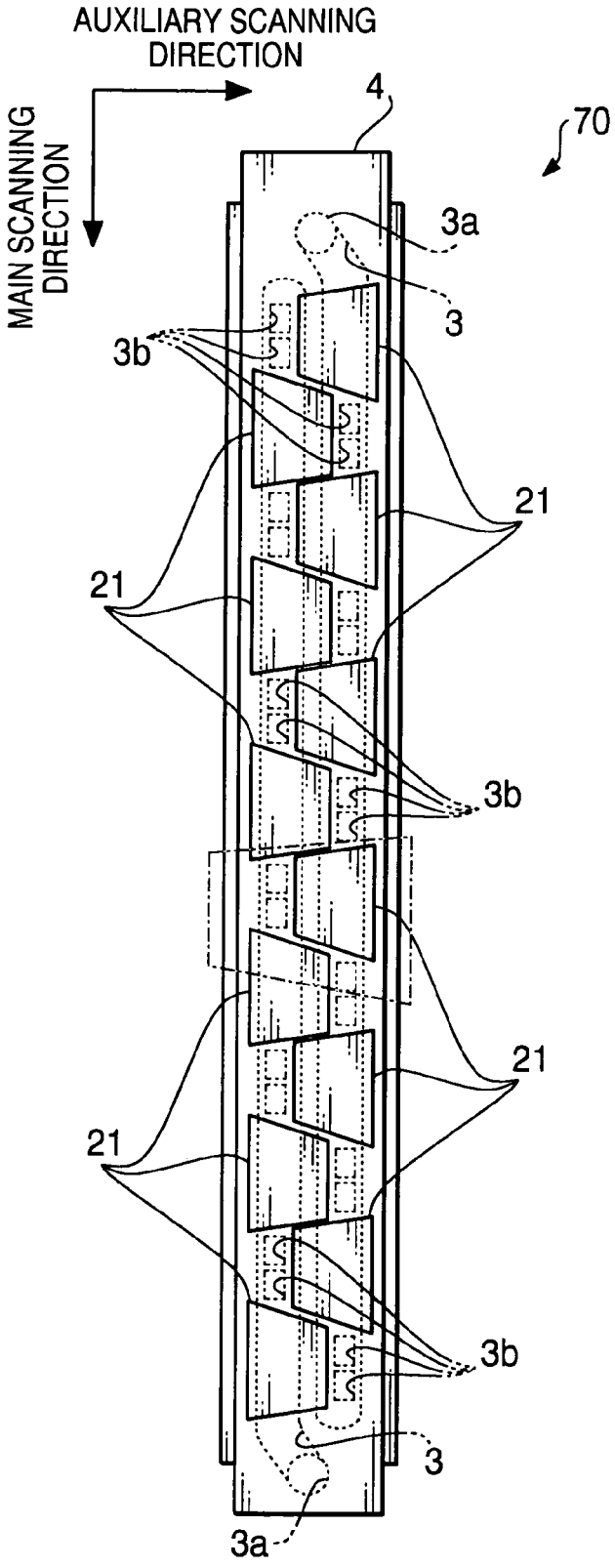
FIG. 4 is a plan view of a head body of the inkjet head.

FIG. 4 is a plan view of the head body 70. In FIG. 4, shapes of the ink reservoirs 3 are indicated by imaginary lines (dashed lines). Bach ink reservoir 3 has an elongated form in a direction parallel with the longitudinal side of the head body 70. The two ink reservoirs 3 are arranged to have a predetermined interval between them.

Each ink reservoir 3 has an opening 3*a* at one end thereof, and communicates with an ink tank (not shown) through the opening 3*a*. Therefore, the ink reservoir 3 is constantly filled with the ink. As shown in FIG. 4, a plurality of openings 3*b* are formed on the base block 71 in pairs along each ink reservoir 3 so as to connect the ink reservoir 3 to the ink flow channel unit 4. The pairs of the openings 3*b*, situated on both of the ink reservoirs 3, are located on the head body 70 in a staggered arrangement.

As shown in FIG. 4, a plurality of actuator units 21 are also located on the head body 70 in a staggered arrangement so that each actuator unit 21 is opposed to the corresponding pair of openings 3*b* in a direction parallel with a shorter side of the rectangular form of the head body 70.

Each actuator unit 21 has a trapezoidal form whose upper and lower sides are parallel with the longitudinal side of the head body 70. Further, the actuator units 21 are located such that upper side portions thereof overlap one another in the direction parallel with the shorter side of the head body 70.

Figure 5:
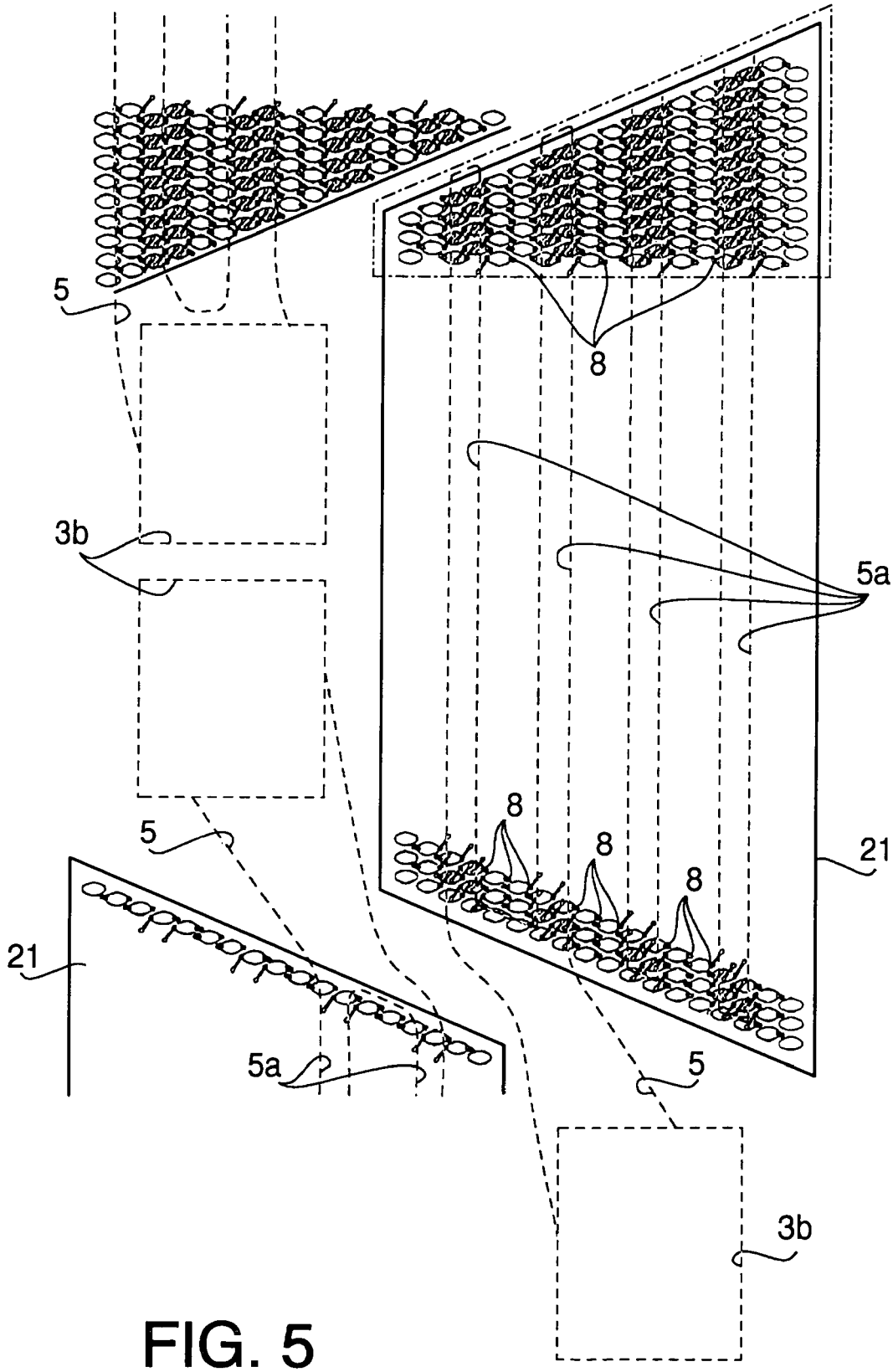
FIG. 5 is an enlarged view of a section of the head body shown in FIG. 4.

FIG. 5 is an enlarged view of a section E indicated in FIG. 4. As shown in FIG. 5, the openings 3*b* respectively communicate with manifolds 5, each of which used as a common ink room for the plurality of nozzles 8. Each manifold 5 branches off into two sub-manifolds 5*a*. In a region in which each actuator unit 21 lies, two pair of sub-manifolds 5*a* (i.e., four sub-manifold 5*a*) are passed. Each pair of sub-manifolds 5*a* is connected to one of two openings 3*b* which are located adjacent to their respective oblique sides of each actuator unit 21.

On a portion of a bottom surface of the ink flow channel unit 4 opposed to a region in which one of the actuator units 21 lies, an ink ejecting area is formed. That is, a plurality of ink ejecting areas are formed on the bottom surface of the head unit 70 for the plurality of actuator units 21. Each ink ejecting area includes a plurality of nozzles 8 arranged in a matrix. In FIG. 5, a portion of the plurality of nozzles 8 are indicated for the sake of simplicity. In actuality, the nozzles are distributed in the entire trapezoidal ink ejecting area.

Figure 6:
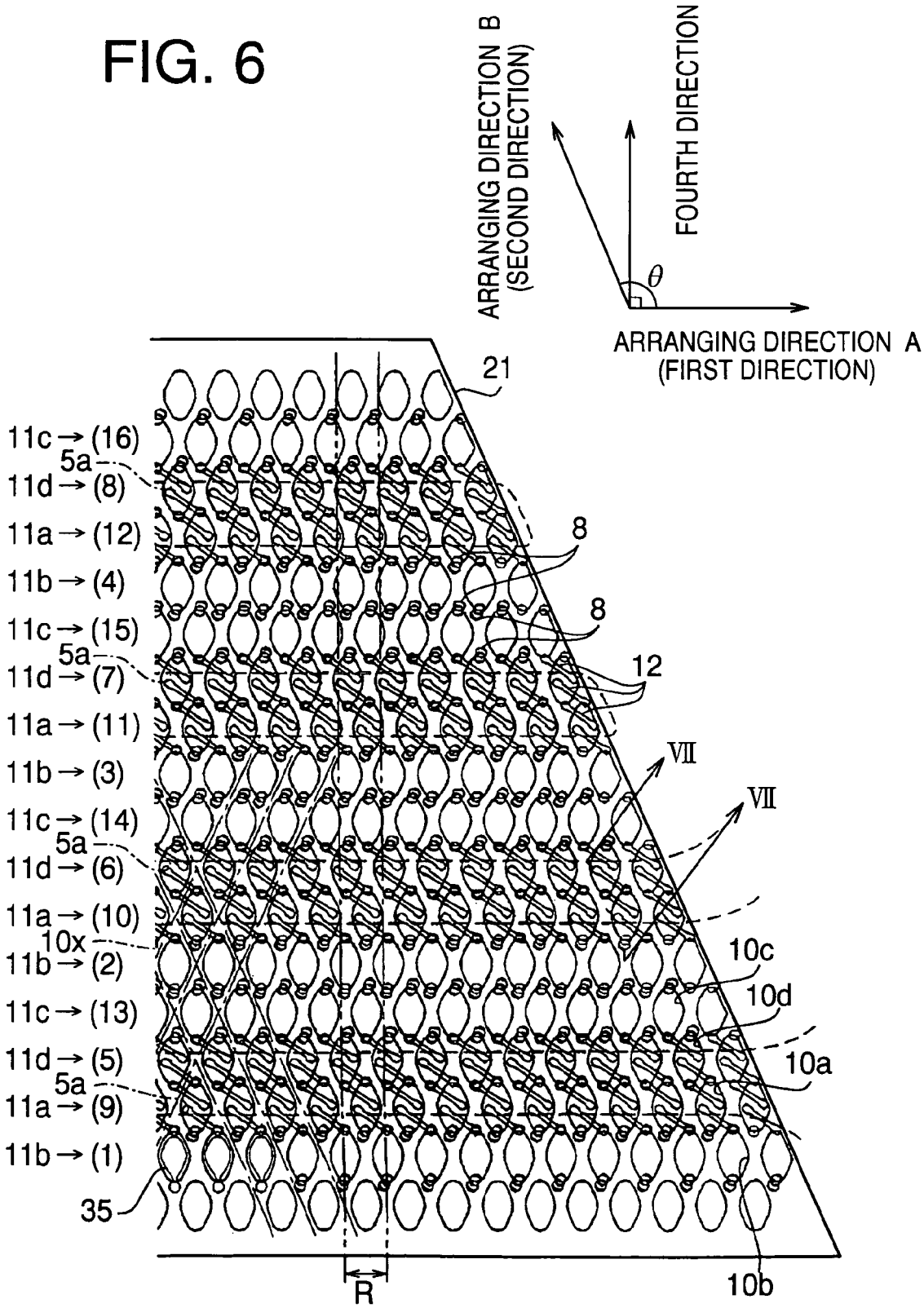
FIG. 6 is an enlarged view of a section of an actuator unit shown in FIG. 5.

FIG. 6 is an enlarged view of a section F indicated in FIG. 5. That is, FIG. 6 shows the head body 70 when it is viewed from the ink ejecting surface (i.e., the bottom surface) side. As shown in FIG. 6, a plurality of pressure chambers 10 are provided respectively for the plurality of nozzles 8. It should be noted that all of elements, including the plurality of pressure chambers 10 and a plurality of apertures 12, which are formed on different layers of the ink flow channel unit 4 are indicated by using a solid line for the sake of simplicity.

Each pressure chamber 10 has a rhombic form of which corners have round forms. The pressure chambers 10 are located within the ink ejecting area such that a longer diagonal line is parallel with the shorter side of the head body 70.

One end portion of each pressure chamber 10 communicates with the nozzle 8, and the other end portion of each pressure chamber 10 communicates with the sub-manifold 5*a*. As shown in FIG. 6, on the actuator unit 21, a plurality of electrodes 35 are provided respectively for the plurality of pressure chambers 10. Similarly to the pressure chamber 10 each electrode 35 has a rhombic form having a size slightly smaller than that of the pressure chamber 10. In FIG. 6, only some of the plurality of electrodes 35 are indicated for the sake of simplicity.

In FIG. 6, a plurality of imaginary areas lox, each having a rhombic shape, are indicated for the explanation of an arrangement of the elements (i.e., the pressure chambers 10, individual electrodes 35, etc.). As shown in FIG. 6, the imaginary areas 10*x* are arranged such that four sides of one imaginary area 10 touch neighboring four imaginary areas 10*x* without the one imaginary area 19 and the neighboring four imaginary areas 10 overlapping one another.

The imaginary areas 10 are arranged in a matrix having an arranging direction A (a first direction) and an arranging direction B (a second direction). The arranging direction A is parallel with the longitudinal direction of the head body 70 and a shorter diagonal line of the rhombic shape of the imaginary area 10*x*. The arranging direction B forms an obtuse angle θ with respect to the arranging direction A.

The pressure chambers 10 are arranged in the arranging direction A to have predetermined intervals corresponding to, for example, 37.5 dpi (dots per inch). Eighteen pressure chambers 10 are arranged in the arranging direction B within each ink ejection area. The eighteen pressure chambers 10 arranged in the arranging direction B include two dummy pressure chambers located both end portions thereof. The dummy pressure chambers do not contribute to the ejection of the ink.

The pressure chambers 10 are categorized into four types of chamber rows 11*a*, 11*b*, 11*c* and 11*d* depending on a positional relationship with the sub-manifold 5*a* when they are viewed along a direction perpendicular to the bottom surface of the head body 70. Hereafter, the direction perpendicular to the bottom surface of the head body is referred to as a third direction, and a direction perpendicular to the first direction (the direction A) on the bottom surface of the head body 70 is referred to as a fourth direction.

Each chamber row is arranged in a line in the arranging direction A. The chamber rows are arranged, from the upper side, by four repetitions of a pattern of row 11*c*, row 11*d*, row 11*a* and row 11*b*.

With regard to pressure chambers 10*a* included in the chamber row 11*a* and pressure chambers 10*b* included in the chamber row 11*b*, the nozzle 8 of the pressure chamber is located at the lower end portion of the rhombic form of the pressure chamber. On the other hand, with regard to pressure chambers 10*c* included in the chamber row 11*c* and pressure chambers 10*d* included in the chamber row 11*d*, the nozzle 8 of the pressure chamber is located at the upper end portion of the rhombic form of the pressure chamber.

With regard to the chamber rows 11*a* and 11*d*, a portion of each pressure chamber (10*a* or 10*d*) overlaps the corresponding sub-manifold 5*a*. On the other hand, with regard to the chamber rows 11*b* and 11*c*, pressure chambers 10*b* and 10*d* are laid without overlapping the sub-manifold 5*a*.

With the above mentioned structure, it becomes possible to broaden the width of the sub-manifold 5*a* as broad as possible with keeping the nozzles 8 and the sub-manifold 5*a* from overlapping when they are viewed along the third direction. Therefore, a smooth ink flow to the pressure chamber 10 can be secured.

Figure 7:
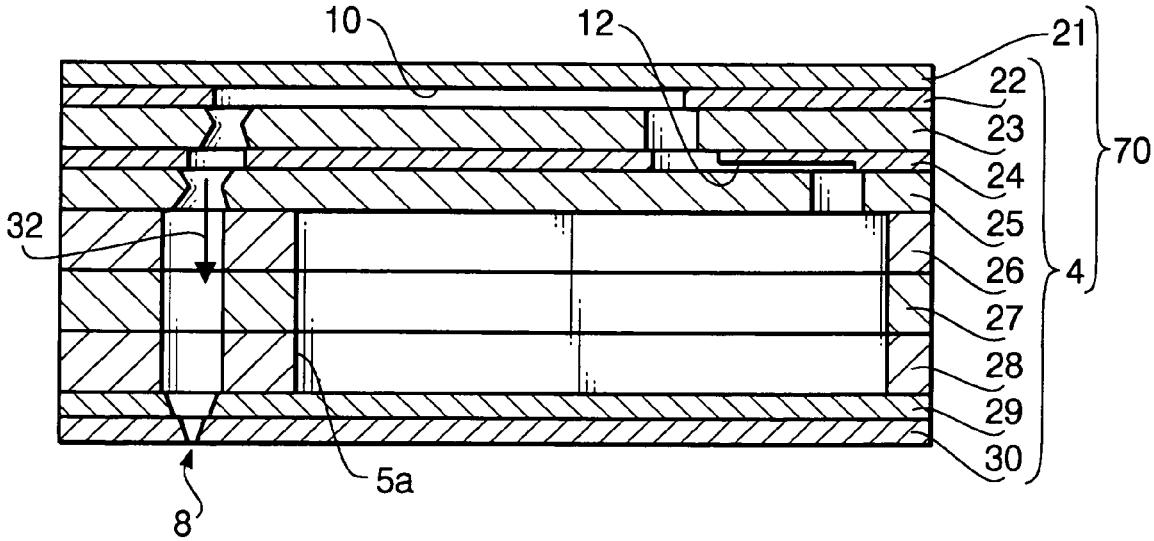
FIG. 7 is a cross sectional view of the head body shown in FIG. 6.

Next, a structure of the head body 70 will be described in detail with reference to FIGS. 7 and 8. FIG. 7 is a cross sectional view of the head body 70 when it is cut along a line VII-VII indicated in FIG. 6. FIG. 7 shows the structure regarding the pressure chamber 10*a* included in the chamber row 11*a* by way of example. In FIG. 7, one ink flow channel 32 is illustrated. In actuality, a number of ink flow channels 32 are formed in the ink flow channel unit 4.

Figure 8:
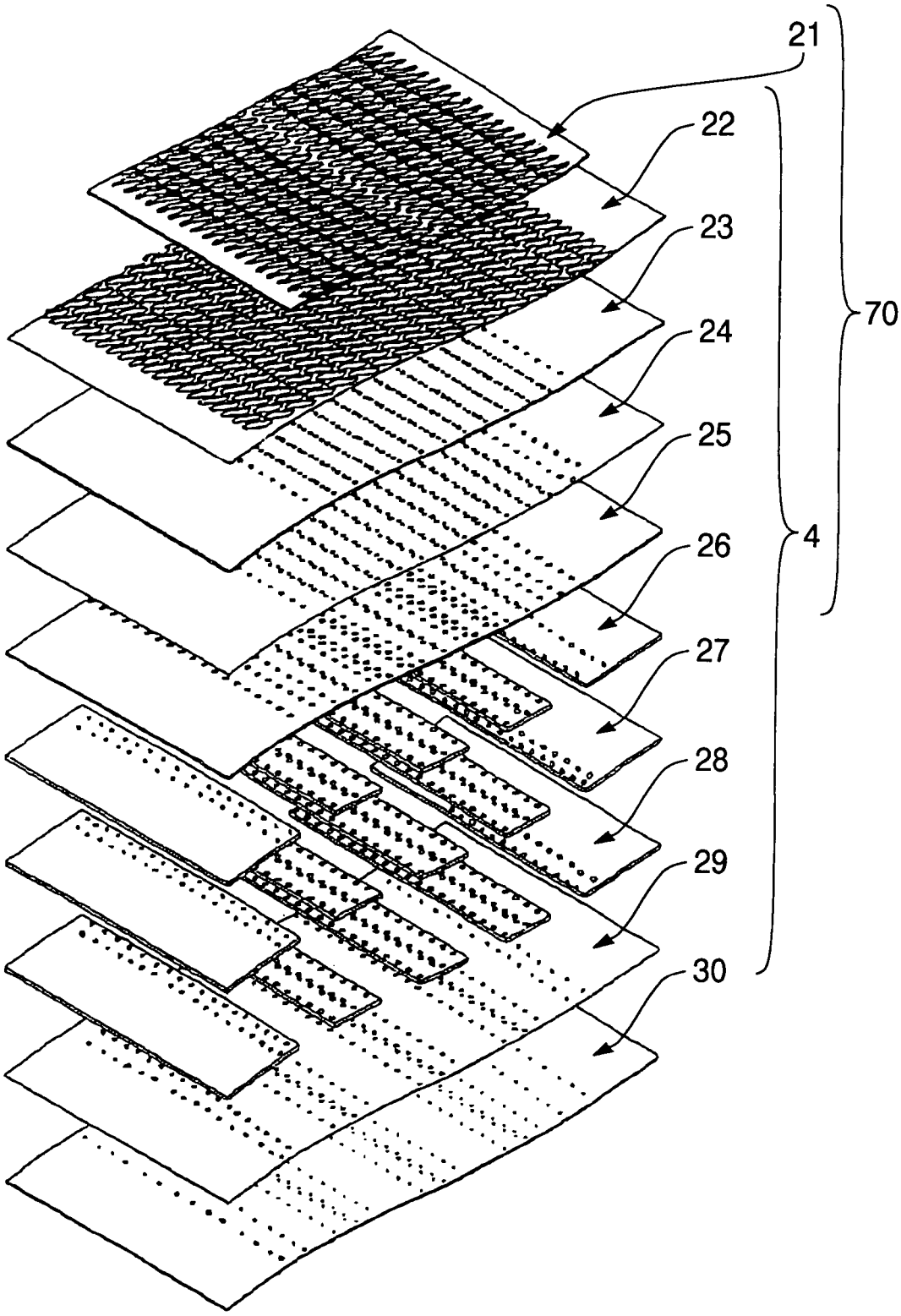
FIG. 8 is a sectional exploded view of the head body.

FIG. 8 is a sectional exploded view of the head body 70. As shown in FIG. 7, the nozzle 8 communicates with the sub-manifold 5*a* through the pressure chamber 10 (10*a*) and the aperture 12. From an outlet of the sub-manifold 5*a* to the nozzle 8, the ink flow channel 32 is formed. The ink flow channel 32 is provided for each of the pressure chambers 10 in the ink flow channel unit 4.

As show in FIG. 8, the head body 70 has the laminated structure composed of ten thin plates having, from the upper side, the actuator unit 21, a cavity plate 22, a base plate 23, an aperture plate 24, a supply plate 25, manifold plates 26, 27 and 28, a cover plate 29, and a nozzle plate 10. The nine plates 22-30 are metal thin plates which are adhered to one another by, for example, diffusion bonding.

Figure 9A:
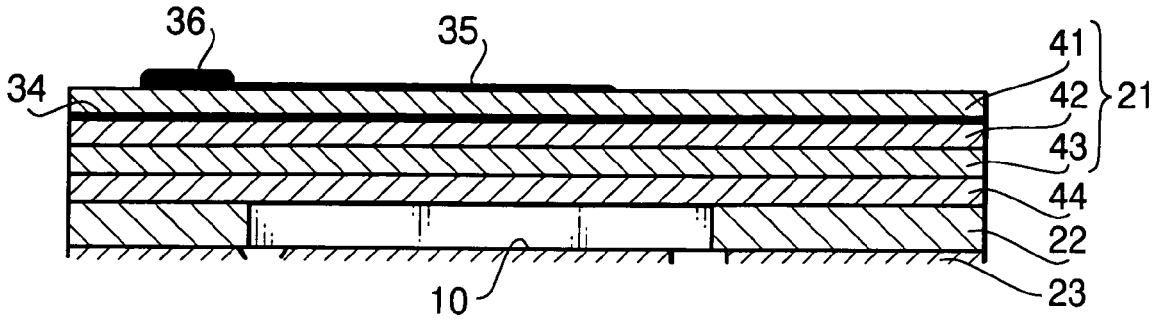
FIG. 9A is a cross sectional view of the actuator unit.

The actuator unit 21 includes four piezoelectric sheets 41-44 (see FIG. 9A). The cavity plate 22 has rhombic openings constituting the pressure chambers 10, respectively. The base plate 23 has two openings. One the openings of the base plate 23 connects the aperture 12 with the pressure chamber 10. The other opening of the base plate 23 connects the pressure chamber 10 with the nozzle 8.

The aperture plate 24 includes the aperture 12 configured to have two openings connected by a half etching region. The aperture unit 24 further has an opening which connects the pressure chamber 10 to the nozzle 8. The supply plate 25 has two openings. One of the openings of the supply late 25 connects the sub-manifold 5*a* with the aperture 12. The other opening of the supply plate 25 connects the pressure chamber 10 with the nozzle 8.

Each of the manifold plates 26-28 has an opening which constitutes the sub-manifold 5*a* when the manifold plates 26-28 are laminated. Each of the manifold plates 26-28 further has an opening which connects the pressure chamber 10 with the nozzle 8. The cover plate 29 has an opening which connects the pressure chamber 10 with the nozzle 8. The nozzle plate 30 has the nozzle 8. The nozzle 8 tapers down toward the lower side (i.e., the bottom surface) of the head body 70.

The nine plates 21-30 are registered with respect to each other and thereafter they are laminated, so that the ink flow channel 32 is formed. As shown in FIG. 7, the ink flow channel 32 extends toward the upper side from the outlet of the sub-manifold 5*a*, extends in the horizontal direction in the aperture 12, and further extends upward toward the pressure chamber 10. The ink flow channel 32 extends horizontally in the pressure chamber 10, extends obliquely toward the lower side, and then extends toward the nozzle 8 in the vertical direction.

Figure 9B:
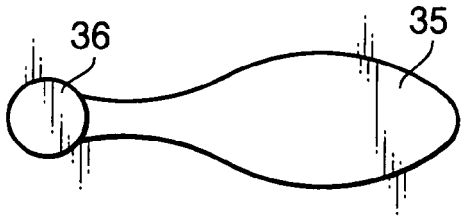
FIG. 9B is a plan view of one of electrodes provided on the actuator unit.

Next, the structure of the actuator unit 21 will be described in detail. FIG. 9A is a cross sectional view of the actuator unit 21. FIG. 9B is a plan view of one of the electrodes 35. As shown in FIG. 9A, the actuator unit 21 has the laminated structure including four piezoelectric sheets 41, 42, 43 and 44, each of which has a thickness of about 15 micrometer. In FIG. 9A, only a portion of the actuator unit 21 including one electrode 35 is indicated. In actuality, each piezoelectric sheet is provided on the entire actuator unit 21.

On the upper side surface of the actuator unit 21, a plurality of electrodes 35 are closely arranged. Such closely located electrodes 35 can be formed on the actuator unit 21 by, for example, the screen process printing. As described above, since the electrodes 35 and the pressure chambers 10 can be laid closely, printing resolution can be enhanced.

Each piezoelectric sheet is made of, for example, lead zirconate titanate (PZT) ceramic material that displays ferroelectricity. On the uppermost piezoelectric sheet 41 the electrode 35 is formed. Between the piezoelectric sheets 41 and 42, a common electrode 34 having a thickness of about 2 micrometer is located. The common electrode 34 expands over the entire region of the actuator unit 21. The electrode 35 and the common electrode 34 are made of, for example, Ag—Pd metal.

The electrode 35 has a thickness of about 1 micrometer. As shown in FIG. 9B, the electrode 35 includes a primary electrode region having a substantially rhombic form when it is viewed as a plan-view, and a secondary electrode region that extends from one acute angle corner of the primary electrode portion. At a tip portion of the secondary electrode region, a circular land 36 having a diameter of about 160 micrometer is formed.

The circular land 36 is made of, for example, gold material including glass frit, and is fixed at the tip portion of the secondary electrode region. The land 36 is electrically connected to an electrode formed on the FPC 50.

The common electrode 34 is grounded. On the FPC 50, a plurality of electrodes and a plurality of lines are formed to respectively connect the electrodes 35 to the driver IC 80 in order to control potentials of the electrodes 35 individually.

Next, driving operation for the actuator unit 21 will be described in detail. The piezoelectric sheet 41 has been polarized in a direction of its thickness. With the above mentioned laminated structure of the actuator unit 21, the piezoelectric sheet 41 is used as an active layer (i.e., a layer including active layer portions), and the other piezoelectric sheets 42-44 are used as non-active layers. Such a structure of the actuator unit 21 is frequently called a unimorph type.

When a certain (minus or plus) potential is applied to the electrode 35, a portion of the piezoelectric sheet 41 can function as the active layer. More specifically, if a direction of an electric filed applied to a portion of the sheet 41 and the direction of polarization of the sheet 41 are substantially equal to each other, the portion of sheet 41 functions as the active layer, and the portion of the sheet 41 contracts by the piezoelectric effect in a direction perpendicular to the direction of the polarization. Hereafter, such a potential that make the direction of the electric field and the direction of the polarization of the portion of the sheet 41 equal to each other, is referred to as an equivalent potential.

Meanwhile, the piezoelectric sheets 42-43 are not supplied with the electric field even if the electric field is applied to the portion of the sheet 41. Therefore, the sheets 42-43 do not contract when the portion of the sheet 41 contracts, which introduces a difference of distortion (in the direction of the polarization) between the sheet 41 and the sheets 42-44. As a result, the portions of the sheets 41-44 located below the electrode 35 are distorted such that they protrudes toward the pressure chamber 10. Such a phenomenon is frequently called a unimorph deformation.

When such a deformation of the sheets 41-44 occurs, the volumetric capacity of the pressure chamber 10 decreases, and thereby the pressure in the pressure chamber 10 increases.

A potential, that make the direction of the electric field and the direction of the polarization of the portion of the sheet 41 opposite to each other, is referred to as an inverse potential. When the inverse potential is applied to the electrode 35, the portions of the sheet 41-43 below the electrode 35 are distorted such that they protrudes toward the upper side (i.e., an electrode 35 side). When such an inverse deformation of the sheets 41-44 occurs, the volumetric capacity of the pressure chamber 10 increases, and thereby the pressure in the pressure chamber 10 is decreased.

The actuator unit 21 is driven by using a basic driving pattern in which initially the equivalent potential is applied to the electrode 35, secondly the inverse potential is applied to the electrode 35, and then the equivalent potential is applied to the electrode 35. With this basic driving pattern, firstly the ink is sucked from the sub-manifold 5*a* into the pressure chamber 10 when the potential of the electrode 35 changes from the equivalent potential to the inverse potential. Next, the ink is ejected from the nozzle 8 when the potential of the electrode 35 changes form the inverse potential to the equivalent potential. The basic driving pattern is accomplished by transmitting a rectangular pulse to the electrode 35 from the driver IC 80.

More specifically, a width of the pulse is set at a certain acoustic length (hereafter, referred to as an interval AL) corresponding to a time required for a pressure wave to propagate from the manifold 5 to the nozzle 8. Since the potential of the electrode 35 is changed form the inverse potential to the equivalent potential when the pressure in the pressure chamber 10 starts to change from negative pressure to positive pressure, two actions to bring a condition of the pressure chamber 10 to the positive pressure are combined. As a result, the ink can be ejected from the nozzle 8 with a high pressure.

In order to eject the ink from the nozzle 8, a potential difference between the equivalent potential and the inverse potential is required to be equal to or more than a certain value. In this embodiment, the equivalent potential is set at 20 volts and the inverse potential is set at −5 volts so as to eject the ink. Hereafter, the voltage of −5V as the inverse potential required to eject the ink is referred to as an inverse potential for ejection.

On the other hand, when it is required not to eject the ink, the inverse potential is set at 0V. Hereafter, the voltage of 0V as the inverse potential is referred to as an inverse potential for non-ejection. The voltages of 20V of the equivalent potential, and −5V and 0V of the inverse potential are indicated by way of example. Therefore, another voltage values may be used as the equivalent voltage and the inverse voltage.

The gray scale is represented by an amount of ink ejected onto the same position of the sheet. In this embodiment, the amount of the ink (i.e., density of a dot) is adjusted by controlling the number of drops of the ink successively ejected onto the same position of the sheet. To successively eject two or more drops of ink form the nozzle 8, two or more pulses are successively inputted to the electrode 35.

An interval of the successive pulses is set equal to the interval AL. Therefore, a cycle of a residual pressure wave of a pressure wave applied by one pulse of the successive pulses becomes equal to a cycle of a pressure wave applied by a succeeding pulse. Further, in this case, a peak of the residual pressure wave caused by the one pulse and a peak of the pressure wave caused by the succeeding pulse become equal to each other, by which the pressure of the pressure wave caused by the succeeding pulse is amplified.

Consequently, a speed of a drop of ink ejected by the succeeding pulse (i.e., the succeeding drop of ink) becomes higher than a speed of a drop of ink ejected by a preceding pulse (i.e., the preceding drop of ink). Accordingly, the succeeding drop of ink catches up with the preceding drop of ink, and therefore the two drops ink are united with each other.

It is noted that such a controlling scheme using the successive pulses having the interval AL enables to eject a desired amount of ink with a relatively low potential difference by use of an amplification effect of the pressure wave and the resident pressure wave.

Figure 10:
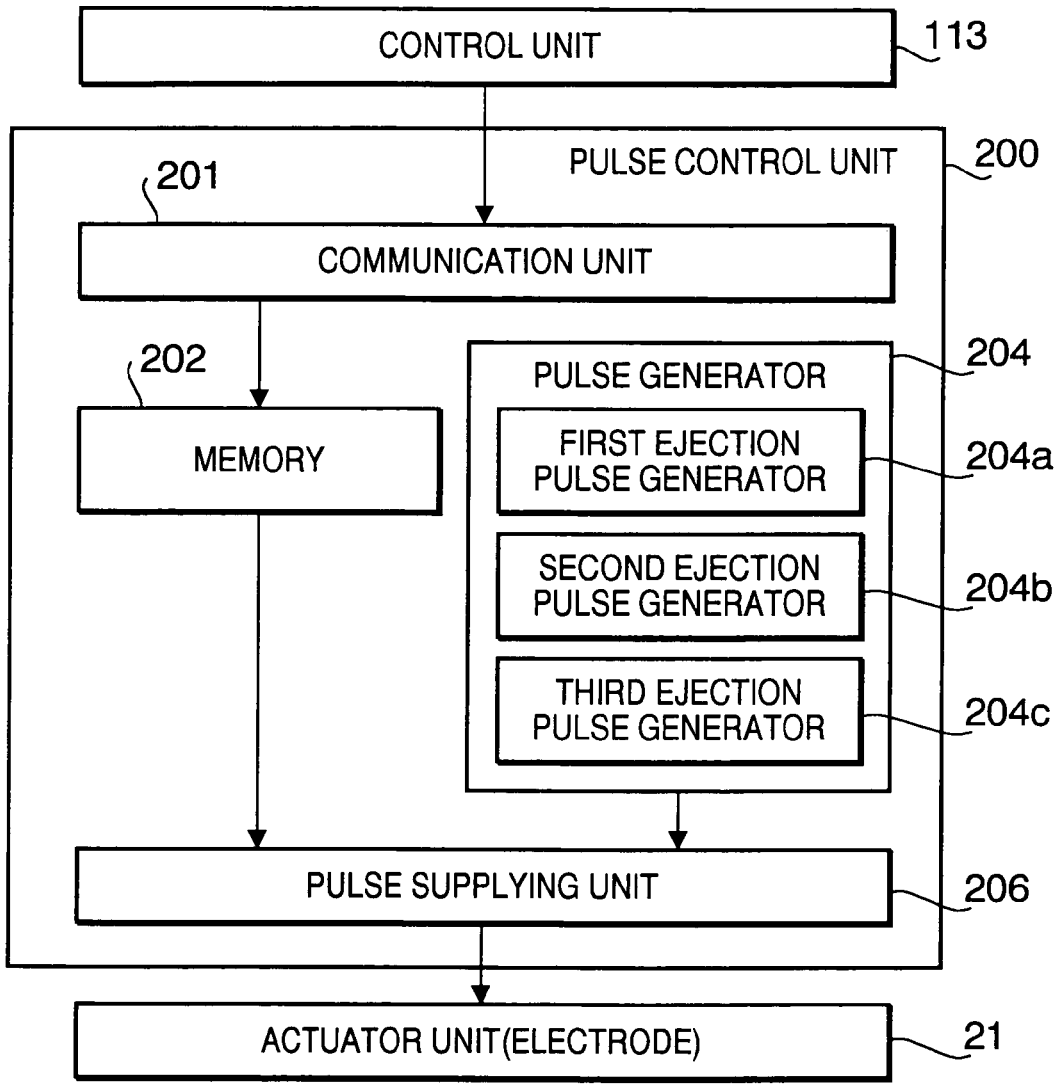
FIG. 10 shows a functional block diagram of a pulse control unit according to a first embodiment.

Next, the function of the pulse control unit 200 will be described in detail. FIG. 10 shows a functional block diagram of the pulse control unit 200. On the printed circuit board 81, a CPU (central processing unit), a RON (read only memory) that stores various programs to be executed by the CPU, and a RAN (random access memory) that is used to store temporarily data for the execution of the program are mounted. The functional blocks, shown in FIG. 10 are accomplished by the functions of the CPU, ROM and RAN mounted on the printed circuit board 81 and circuits provided in the driver IC 80.

As shown in FIG. 10, the pulse control unit 200 includes a communication unit 201, a memory 202, a pulse generator 204, and a pulse supplying unit 206. In FIG. 10, the control unit 113 connected to the communication unit 201 and the actuator unit 21 connected to the pulse supplying unit 206 are also indicated.

The communication unit 201 communicates with the control unit 113. The control unit 113 sends the image data and timing data, regarding one of color components of magenta, yellow, cyan and black, to corresponding one of the inkjet heads 1. The timing data includes timing information for printing the image data.

The communication unit 201 receives the image data and the timing data from the control unit 113 and stores them into the memory 202. The memory 202 is constituted by the RAN mounted on the printed circuit board 81.

The pulse generator 204 generates pulses to be applied to electrodes 35 for, ejecting ink. Hereafter, a pulse pattern generated by the pulse generator 204 is referred to as an ejection pulse pattern. The pulse generator 204 includes a first ejection pulse generator 204*a*, a second ejection pulse generator 204*b* and a third ejection pulse generator 204*c*.

The first, second, and third pulse ejection generators 204*a*, 204*b* and 204*c* generate a plurality of types of ejection pulse patterns for each of gray scales based on the image data. More specifically, the amount of ink to be ejected from the nozzle is selected from three levels of the amounts of ink based on the gray scale information, and the number of drops of ink is determined from the selected level.

Each of the first, second, and third ejection pulse generators 204*a*, 204*b* and 204*c* generates three types of ejection pulse patterns respectively corresponding to the three levels of amounts of ink. The ejection pulse patterns respectively generated by the first, second, and third pulse generators 204*a*, 204*b* and 204*c* are phase shifted with respect to each other.

The ejection pulse pattern includes a plurality of negative pulses, each of which has a pulse width of about 5.5 micro second (i.e., the interval AL). The number of succeeding negative pulses in the ejection pulse patter coincides with the determined number of drops of ink. Further, the ejection pulse pattern has a narrow negative pulse having a pulse width of half of the interval AL in its last part (see FIGS. 11A-11C). The last narrow negative pulse is a cancel wave which generates pressure in the pressure chamber 10 for canceling remaining pressure in the pressure chamber 10. For example, when the selected number of drops of ink is three, the ejection pulse pattern having the three succeeding negative pulses and one narrow negative pulse is generated.

Figure 11A:
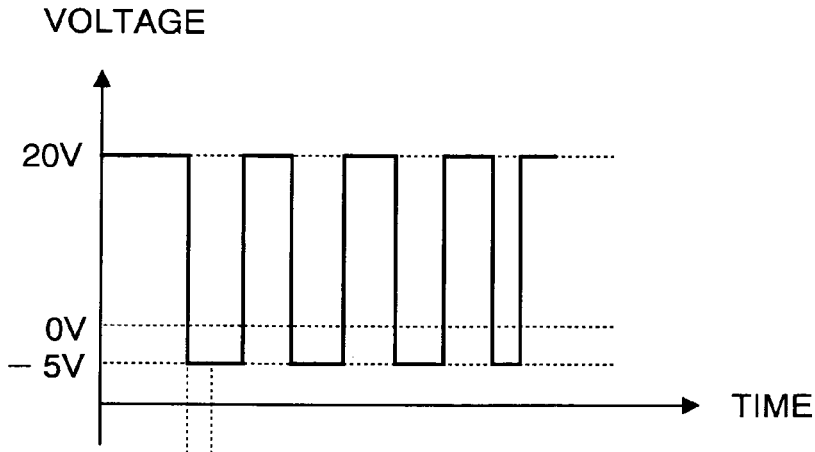
FIG. 11A shows an example of an ejection pulse pattern generated by a first ejection pulse generator in the pulse control unit.
Figure 11B:
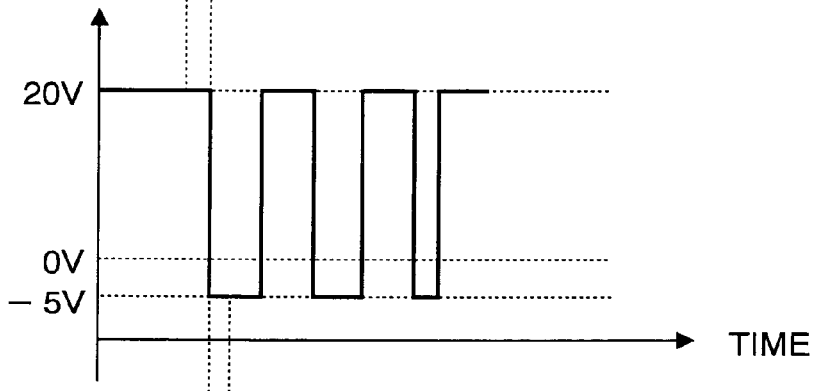
FIG. 11B shows an example of the ejection pulse patter generated by a second ejection pulse generator in the pulse control unit.
Figure 11C:
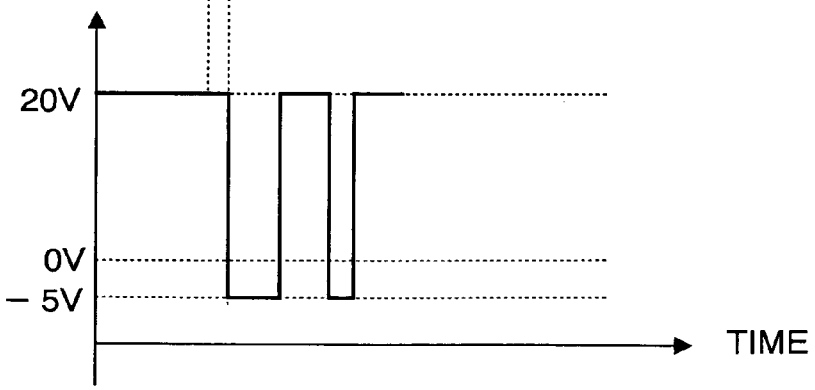
FIG. 11C shows an example of the ejection pulse patter generated by a third ejection pulse generator in the pulse control unit.

FIG. 11A shows an example of the ejection pulse pattern generated by the first ejection pulse generator 204*a*. The ejection pulse pattern of FIG. 11A shows a case where the number of drops of ink is three. FIG. 11B shows an example of the ejection pulse patter generated by the second ejection pulse generator 204*b*. The ejection pulse pattern of FIG. 11B shows a case where the number of drops of ink is two. FIG. 11C shows an example of the ejection pulse patter generated by the third ejection pulse generator 204*c*. The ejection pulse pattern of FIG. 11C shows a case where the number of drops of ink is one.

As shown in FIGS. 11A-11C, the ejection pulse pattern generated by the second ejection pulse generator 204*b* is delayed by half (i.e., 2.5 μs) of the interval AL from the ejection pulse pattern generated by the first ejection pulse generator 204*a*. The ejection pulse pattern generated by the third ejection pulse generator 204*c* is delayed by half of the interval AL from the ejection pulse pattern generated by the second ejection pulse generator 204*b*.

As described in detail later, by using ejection pulse patterns which are delayed with respect to each other by time more than half of the interval AL, it becomes possible to sufficiently suppress the effect of the structural crosstalk by changing the timing of ink ejection among the plurality of pressure chambers.

The pulse supplying unit 206 supplies the ejection pulse patterns to the electrodes 35 of the actuator unit 21 based on a predetermined supplying pattern and the image data stored in the memory 202. The predetermined supplying pattern represents a correspondence between the electrodes 35 and the ejection pulse patterns of the first, second and third ejection pulse generators 204*a*, 204*b* and 204*c*. For each of the plurality of electrodes 35, the predetermined supplying pattern represents information on which of the ejection pulse patterns of the first, second and third ejection pulse generators should be supplied to each electrode 35.

Figure 12A:
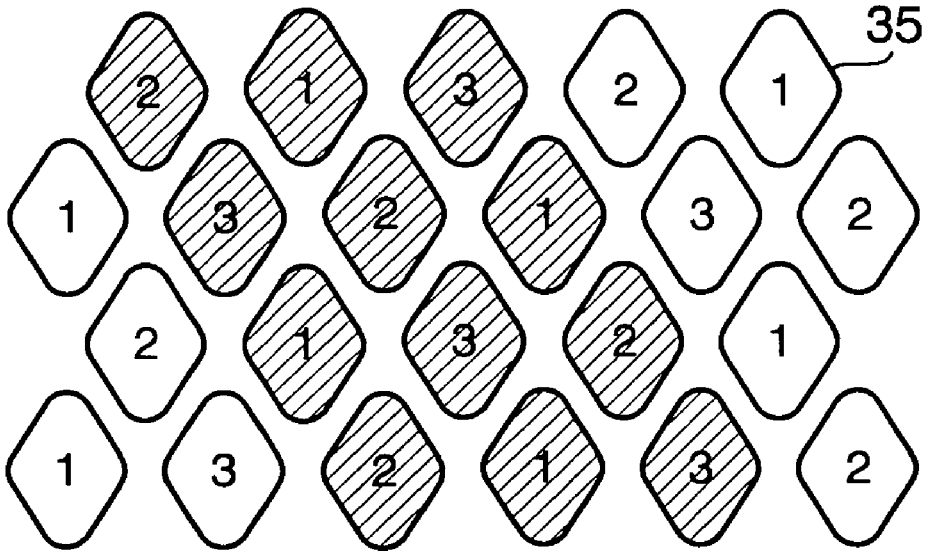
FIG. 12A shows an example of predetermined supplying patterns used in a pulse supplying unit of the pulse control unit.
Figure 12B:
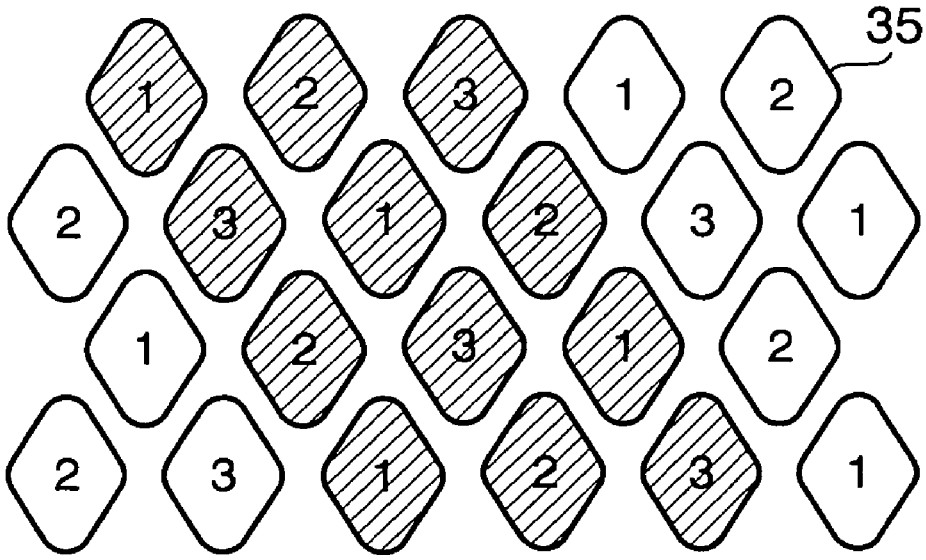

FIGS. 12A and 12B show examples of the predetermined supplying patterns. As shown in FIGS. 12A and 12B, each electrode 35 has a rhombic shape. In FIGS. 12A and 12B, the electrode 35 assigned the number "1" means that the ejection pulse pattern generated by the first ejection pulse generator 204*a* is supplied to it, the electrode 35 assigned the number "2" means that the ejection pulse pattern generated by the second ejection pulse generator 204*b* is supplied to it, and the electrode 35 assigned the number "3" means that the ejection pulse pattern generated by the third ejection pulse generator 204*c* is supplied to it.

In FIGS. 12A and 12B, a diagonally shaded area represents electrodes 35 corresponding to nozzles which are to eject ink. Hereafter, such nozzles which are to eject ink are frequently referred to as ejection nozzles.

In FIG. 12A, the ejection pulse patterns "1", "2" and "3" are assigned to the electrodes 35 in a staggered arrangement. With this structure, the electrodes 35 (corresponding to the ejection nozzles), which are located adjacent to a target electrode 35 and are not located along a line passing through acute angle portions of the rhombic shape of the target electrode 35, are supplied with ejection pulse patterns whose phases are different from the phase of the ejection pulse pattern of the target electrode 35.

The pulse supplying unit 206 selects the ejection pulse pattern to be supplied to the electrode 35 from among the ejection pulse patterns of the first, second and third ejection pulse generators in accordance with the gray scale of the electrode 35, and supplies the selected ejection pulse pattern to the electrode 35.

FIG. 12B shows another example of the predetermined supplying pattern. In FIG. 12B, the ejection pulse patterns "1", "2" and "3" are horizontally aligned. Such an arrangement of the ejection pulse patterns also attains the advantage attained by the arrangement shown in FIG. 12A.

Figure 13:
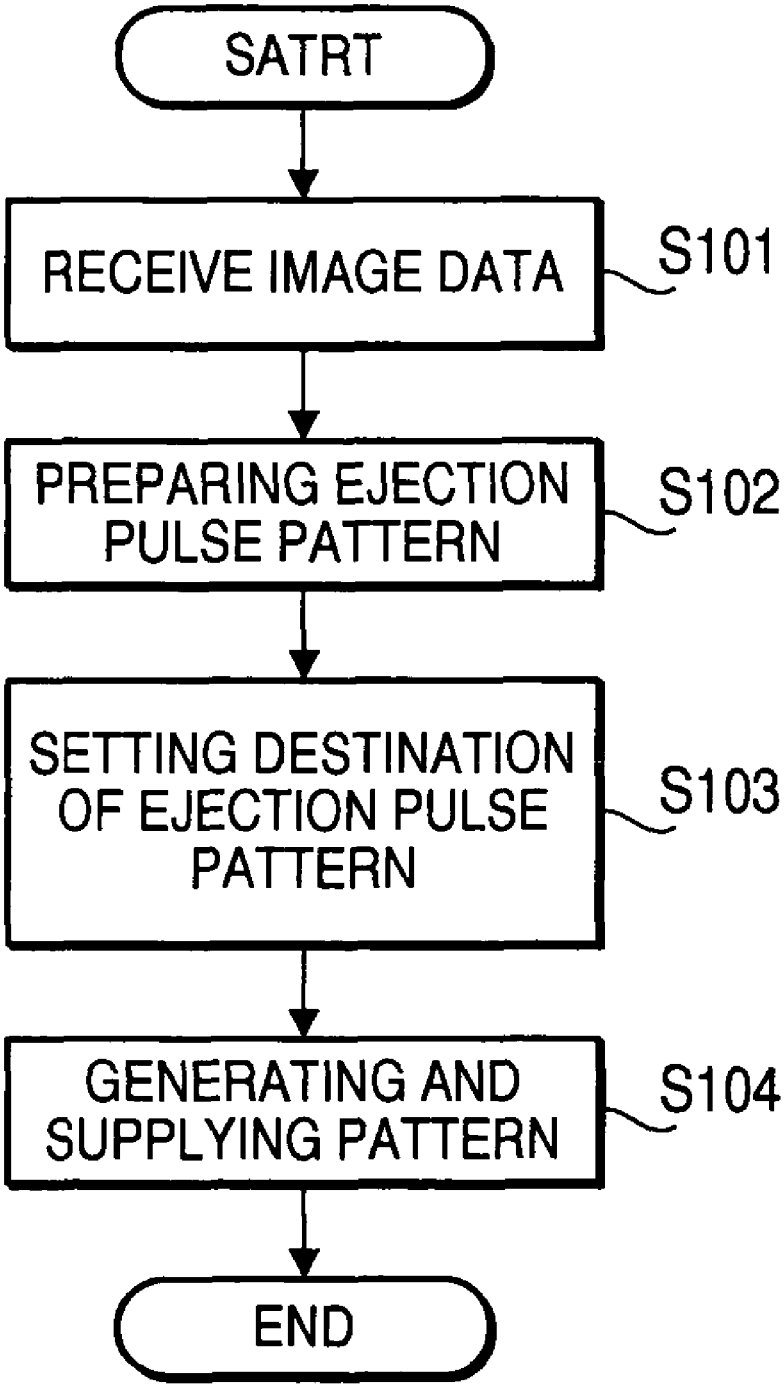
FIG. 13 is a flowchart showing a pulse supplying process executed by the pulse control unit according to the first embodiment.

Next, operation of the pulse control unit 200 will be described. FIG. 13 is a flowchart showing a pulse supplying process executed by the pulse control unit 200. Then the power of the inkjet printer 101 is turned on, the pulse control unit 200 initially waits for the image data and the timing data. In step S101, the communication unit 201 receives the image data and the timing data transmitted by the control unit 113, and stores the image data and the timing data into the memory 202.

Next, in step S102, each of the first, second and third ejection pulse generator 204*a*, 204*b* and 204*c* makes the setting to prepare ejection pulse patterns for all of the gray scales. Next, in step S103, the pulse supplying unit 206 makes the setting to select the ejection pulse pattern to be supplied to each electrode 35 (corresponding to each ejection nozzle) from among the ejection pulse patterns prepared by the pulse generator 204 based on the image data and the predetermined supplying pattern.

In step S104, the pulse generator 204 generates the ejection pulse patterns in accordance with the setting made in step S102, and the pulse supplying unit 206 supplies the ejection pulse patterns to the electrodes 35 in accordance with the setting made in step S103. Then, the pulse supplying process terminates.

According to the first embodiment, since the plurality of ejection pulse patterns whose phases are different from each other are supplied to the electrodes 35 in accordance with the predetermined supplying pattern, the timings at which the electrodes 35, which are located adjacent to a target electrode 35 and are not located along a line passing through acute angle portions of the rhombic shape of the target electrode 35, are driven are different from the timing at which the target electrode 35 is driven. Consequently, it becomes possible to sufficiently suppress the effect of the structural crosstalk.

Further, according to the first embodiment, maximum electric power consumption can be reduced. Therefore, space saving and cost reduction of the inkjet printer 101 are attained.

Since the pulse supplying unit 206 can use the predetermined supplying pattern to supply the ejection pulse patterns to the electrodes 35, the timings of ink ejection for the ejection nozzles can be determined quickly.

In this embodiment, each of the electrode 35 and the pressure chamber 10 has the form of a parallelogram. Therefore, pressure chambers 10 and the electrodes 35 can be arranged densely.

In this embodiment, the pulse generator 204 has three ejection pulse generators (204*a*, 204*b* and 204*c*) which generate ejection pulse patterns having different phases. The pulse generator 204 may be configured to have two, four, or more than four ejection pulse pattern generators which generate ejection pulse patterns having different phases.

Figure 14A:
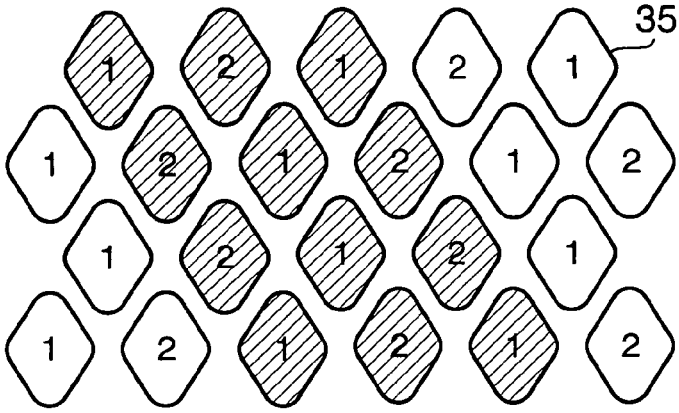
FIG. 14A shows an example of the predetermined supplying pattern when a timing number is two.

When the pulse generator 204 has two ejection pulse generators generating two types of ejection pulse patterns having different phases, the predetermined supplying pattern may be configured as shown in FIG. 14A. In an example of the predetermined supplying pattern shown in FIG. 14A, the electrodes 35, which are adjacent to a target electrode 35 and are located along a line passing through two obtuse angle portions of the rhombic shape of the target electrode 35, are supplied with ejection pulse patterns whose phases are different from the ejection pulse pattern of the target electrode 35. With this structure, the structural crosstalk between adjacent pressure chambers can be suppressed.

Figure 14B:
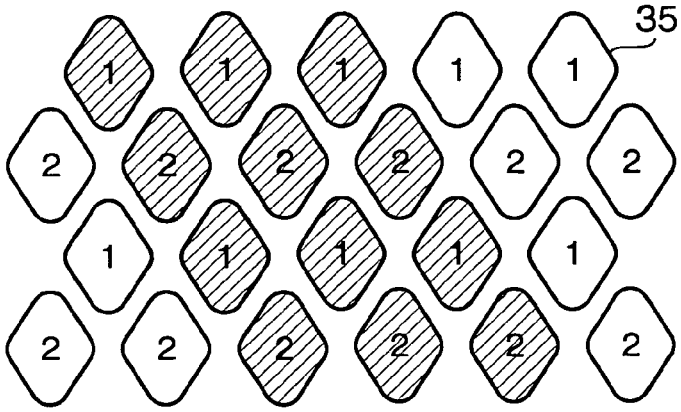
FIG. 14B shows another example of the predetermined supplying pattern when the timing number is two.

As an alternative to the predetermined supplying pattern shown in FIG. 14A, the predetermined supplying pattern may be configured as shown in FIG. 14B. In FIG. 14B, a row of electrodes 35 arranged horizontally (corresponding to a row of pressure chambers arranged horizontally) is supplied with the ejection pulse pattern different from the ejection pulse pattern supplied to an adjacent row of electrodes 35. With this structure, the structural crosstalk between adjacent rows of pressure chambers can be suppressed.

Figure 14C:
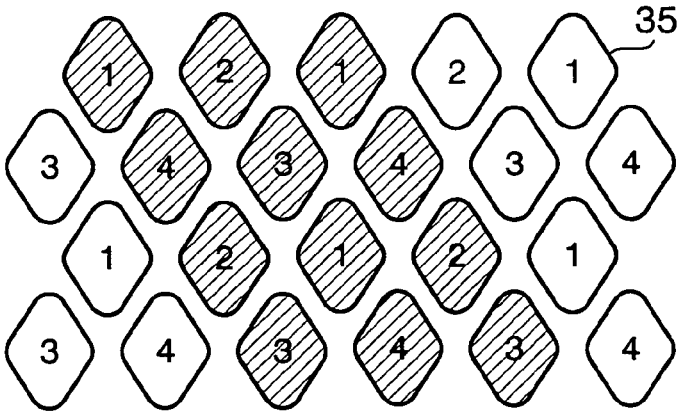
FIG. 14C shows an example of the predetermined supplying pattern when the timing number is four.

When the pulse generator 204 has four ejection pulse generators generating four types of ejection pulse patterns having different phases, the predetermined supplying pattern may be configured as shown in FIG. 14C. In an example of the predetermined supplying pattern shown in FIG. 14C, electrodes 35, which are located adjacently to a target electrode 35 in a direction of a line passing through two obtuse angle portions and in a direction of a line passing through two acute angle portions of the rhombic shape of the target electrode 35, are supplied with ejection pulse patterns whose phases are different from the ejection pulse pattern of the target electrode 35.

With this structure, the structural crosstalk between adjacent pressure chambers and the structural crosstalk between adjacent rows of pressure chambers are suppressed.

Second Embodiment

Figure 15:
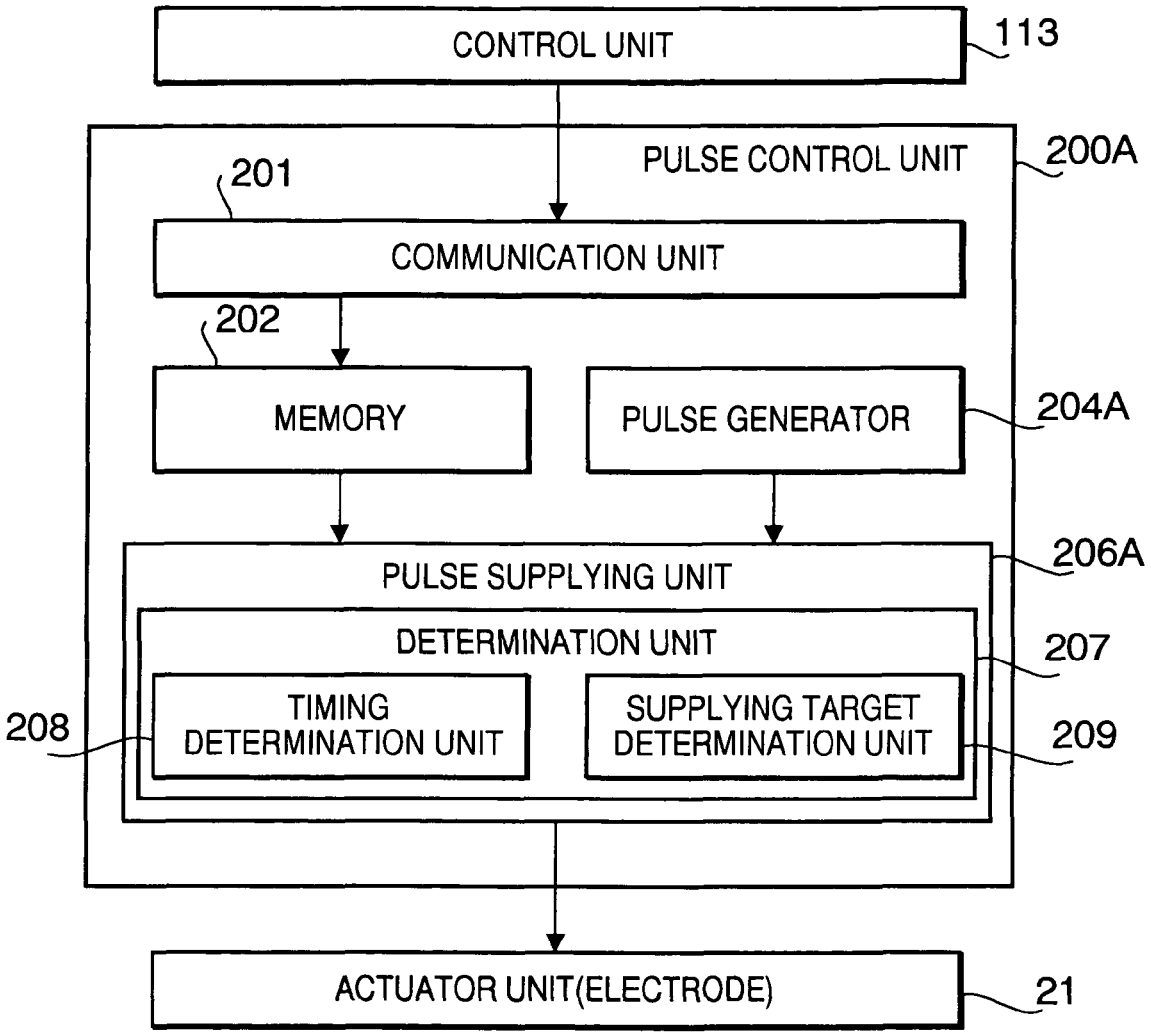
FIG. 15 shows a functional block diagram of a pulse control unit according to a second embodiment.
Figure 16A:
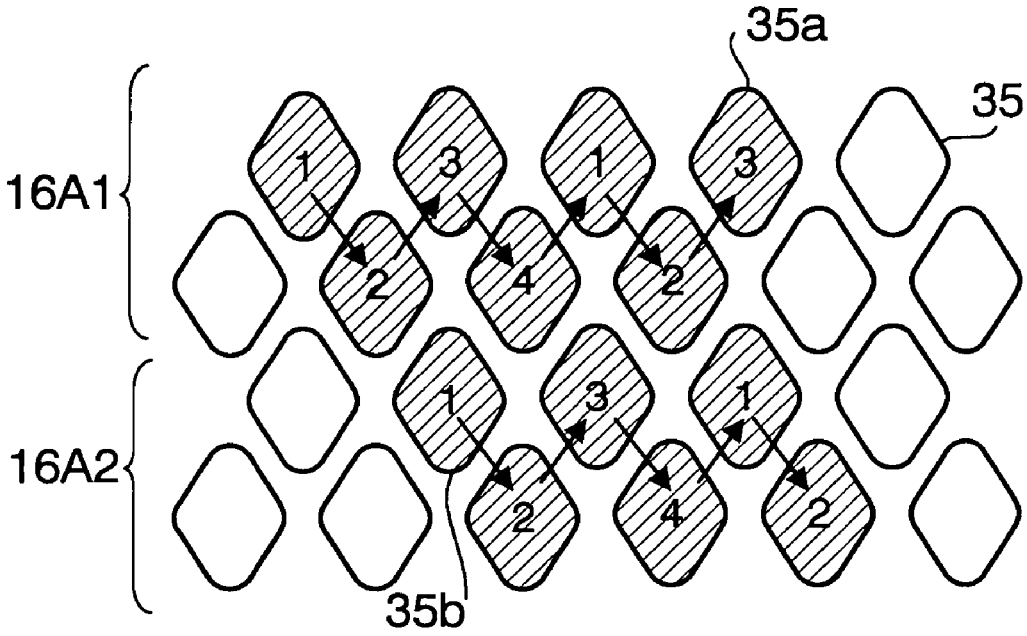
FIG. 16A illustrates a way that a supplying target determination unit determines the type of the ejection pulse pattern for each of electrodes when the timing number is four.
Figure 16B:
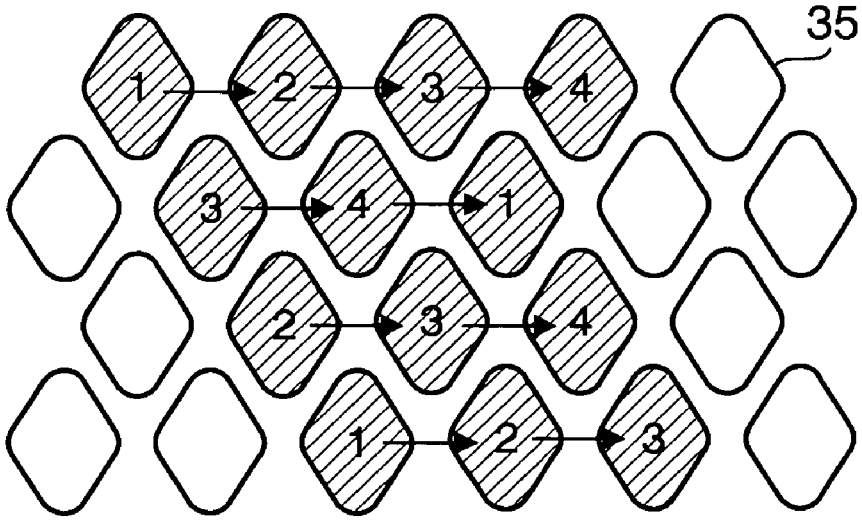
FIG. 16B illustrates another way that the supplying target determination unit determines the type of the election pulse pattern for each of electrodes when the timing number is four.

Next, an inkjet printer according to a second embodiment of the invention will be described. Since in this embodiment only a pulse control unit 200A is different from the pulse control unit 200 of the first embodiment, only the feature of the pulse generator 200A is described. In FIGS. 15, 16A and 16B, to elements which are substantially the same as those of the first embodiment, the same reference numbers are assigned, and the explanations thereof will not be repeated.

FIG. 15 is a functional block diagram of the pulse control unit 200A according to the second embodiment. The pulse control unit 200A has the communication unit 201, the memory 202, a pulse generator 204A, and a pulse supplying unit 206A.

The pulse generator 204A generates a plurality of types of ejection pulse patterns having different phases in accordance with a timing number designated by the pulse supplying unit 206A. Further, the pulse generator 204A can generate ejection pulse patterns having different pulse numbers, respectively corresponding to gray scales, for each of the plurality of types of ejection pulse patterns having different phases.

For example, when the timing number designated by the pulse supplying unit 206A is four, the pulse generator 204A generates four succeeding ejection pulse patterns in which a successive ejection pulse pattern is delayed by half (2.7 μS) of the interval AL (5.5 μS) from a preceding ejection pulse pattern. For each of the four types of ejection pulse patterns having different phases, ejection pulse patterns having different number of pulses respectively corresponding to the gray scales are prepared.

The pulse supplying unit 206A selectively supplies the ejection pulse patterns generated by the pulse generator 204A to the electrodes 35. The pulse supplying unit 206A includes a determination unit 207 which determines a condition concerning the supplying of pulses to the electrodes 35.

More specifically, the determination unit 207 includes a timing determination unit 208 and a supplying target determination unit 209.

The timing determination unit 208 determines the timing number (i.e., the number of types of the ejection pulse patterns to be generated by the pulse generator 204A) based on the image data. The timing number is determined in accordance with the number of ejection nozzles such that the timing number increases as the number of ejection nozzles increases.

The supplying target determination unit 209 determines, for each of the electrodes 35, which type of the ejection pulse patterns is supplied to the electrode 35 based on the image data and the timing number. The way that the supplying target determination unit 209 determines the type of the ejection pulse pattern is as follows.

FIG. 16A illustrates the way that the supplying target determination unit 209 determines the type of the ejection pulse pattern for each of the electrodes 35. FIG. 16A shows a case where the timing number is four.

In FIGS. 16A and 16B, each electrode 35 is indicated by a rhombic shape, and a diagonally shaded area represents electrodes 35 corresponding to ejection nozzles. In FIGS. 16A and 16B, the electrode 35 assigned the number "1" means that an ejection pulse pattern "1" is supplied to it, the electrode 35 assigned the number "2" means that an ejection pulse pattern "2" delayed by half of the interval AL from the ejection pulse pattern "1" is supplied to it, and the electrode 35 assigned the number "3" means that an ejection pulse pattern "3" delayed by half of the interval AL from the ejection pulse pattern "2" is supplied to it. Further, the electrode 35 assigned the number "4" means that an ejection pulse pattern "4" delayed by half of the interval AL from the ejection pulse pattern "3" is supplied to it In an example of FIG. 16A, the four ejection pulse patterns "1", "2", "3" and "4" are assigned to the electrodes 35 in a staggered arrangement. When the ejection pulse pattern of a target electrode 35 is equal to at least one of electrodes which are located adjacently to the target electrode 35 in the direction of the line passing through the two acute angle portions of the rhombic shape of the target electrode 35, the target electrode 35 is assigned the next number of the type of the ejection pulse pattern.

For example, as shown in FIG. 16A, since the last electrode 35*a* of an upper row of a staggered arrangement 16A1 of electrodes is assigned the pattern "3", the first electrode 35*b* of a next row of the staggered arrangement 16A2 of electrodes is to be assigned the pattern "4". However, the pattern "4" is assigned to an upper right position of the electrode 35*b*. Therefore, according to the embodiment, the electrode 35*b* to assigned the next number "1" of the type of the ejection pulse pattern.

FIG. 16B illustrates another way that the supplying target determination unit 209 determines the type of the ejection pulse pattern for each of the electrodes 35. FIG. 16B also shows a case where the timing number is four. In this example, the ejection pulse patterns "1", "2", "3" and "4" are assigned to the electrodes 35 (corresponding to the ejection nozzles) in this order in a direction as indicated by arrows in FIG. 16B. Similarly to the example of FIG. 16A, when the ejection pulse pattern of a target electrode 35 is equal to at least one of electrodes which are located adjacently to the target electrode 35 in the direction of the line passing through the two acute angle portions of the rhombic shape of the target electrode 35, the target electrode 35 is assigned the next number of the type of the ejection pulse pattern.

The pulse supplying unit 206A supplies the ejection pulse pattern, generated by the pulse generator 204A, to each of the electrode 35 (corresponding to the ejection nozzles) based on the type of the ejection pulse pattern determined by the supplying target determination unit 209 and the gray scale.

Figure 17:
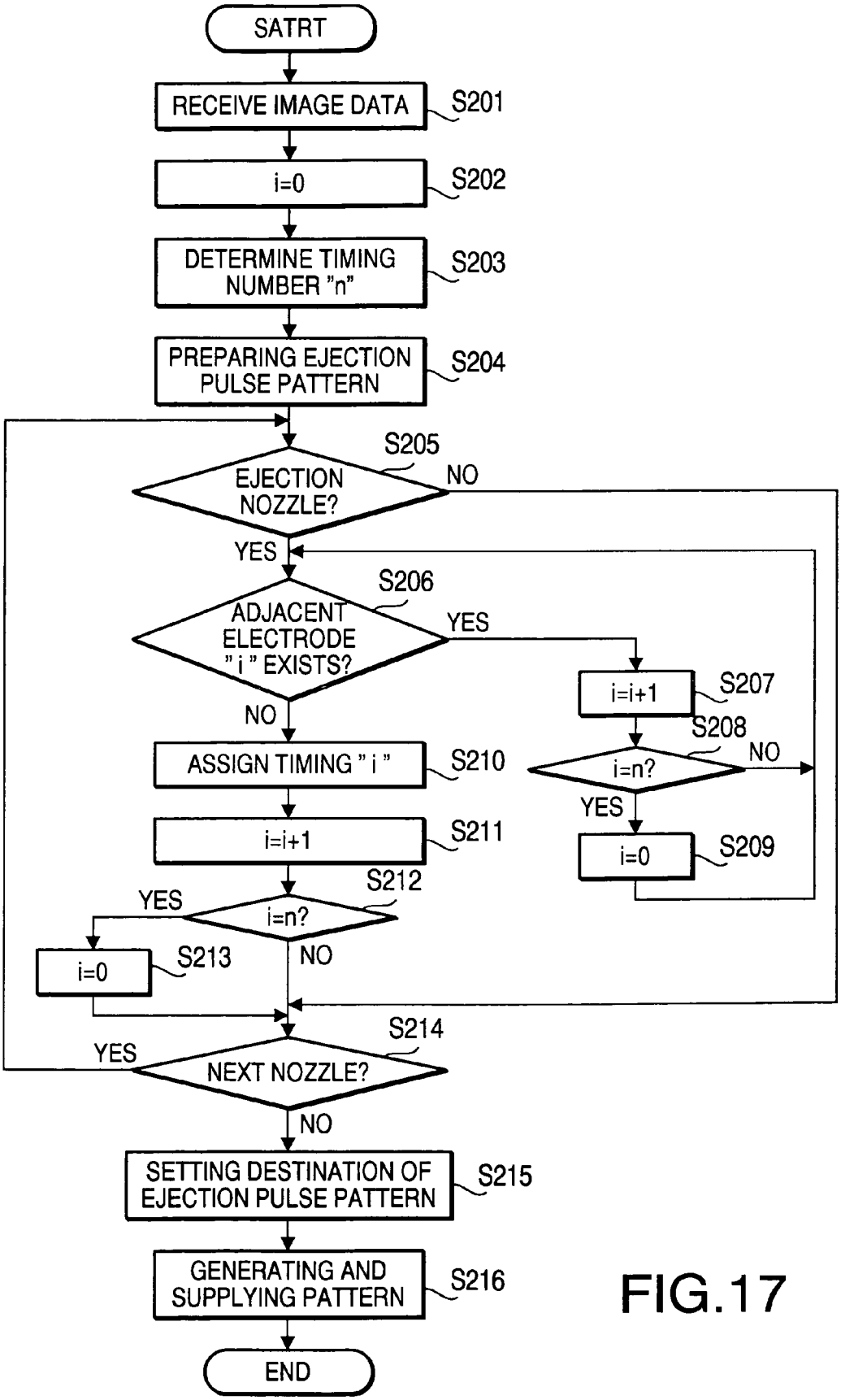
FIG. 17 is a flowchart showing a pulse supplying process executed by the pulse control unit according to the second embodiment.

Next, operation of the pulse control unit 200A will be described. FIG. 17 is a flowchart illustrating a pulse supplying process executed by the pulse control unit 200A. When the power of the inkjet printer 101 is turned on, the pulse control unit 200A initially waits for the image data and the timing data.

In step S201, the communication unit 201 receives the image data and the timing data transmitted by the control unit 113, and stores the image data and the timing data into the memory 202. In step S202, a pointer "i" indicative of the type of the ejection pulse pattern (i.e., a pulse pattern type) is reset to zero.

Next, in step S203, the timing number "n" is determined by the timing determination unit 208 based on the image data stored in the memory 202. In step S204, the pulse generator 204A operates to prepare generation of the ejection pulse patterns having different phases for each of the gray scales. For example, if the timing number "n" determined by the timing determination unit 208 is four, preparation operation for generating, for each of the gray scales, four types of ejection pulse patterns having different phases is performed.

Next, in step S205, it is determined whether a current nozzle (i.e., a current electrode) is the ejection nozzle or not. When the current nozzle is not the ejection nozzle (S205: NO), control proceeds to step S214. When the current nozzle is the ejection nozzle (S205: YES), control proceeds to step S206.

In step S206, it is determined whether the pulse pattern type "1" of the current electrode is equal to one of electrodes 35 located adjacently to the current electrode 35. When the pulse pattern type "i" of the current electrode is equal to one of pulse pattern types of the electrodes 35 located adjacently to the current electrode 35 (S206: YES), control proceeds to step S207 where the pointer "i" indicative of the pulse pattern type "i" is incremented.

In step S208, it is determined whether the pointer "i" is equal to the timing number "n". When the pointer "i" is not equal to the timing number "n" (S208:NO), control returns to step S206. When the pointer "i" is equal to the timing number "n" (S208:YES), control proceeds to step S209 where the pointer "i" is reset to zero. Then, control returns to step S206.

When the pulse pattern type "i" of the current electrode is not equal to one of the pulse pattern types of electrodes 35 located adjacently to the current electrode 35 (S206: NO), control proceeds to step S210. In step S210, the current electrode 35 is assigned the pulse pattern type "i".

Next, in step S211, the pointer "i" is incremented. In step S212, it is determined whether the pointer "i" is equal to the timing number "n". When the pointer "i" is not equal to the timing number "n" (S212:NO), control proceeds to step S214. When the pointer "i" is equal to the timing number "n" (S212:YES), control proceeds to step S213 where the pointer "i" is reset to zero.

Next, in step S214, it is determined whether a next nozzle (a next electrode) to be processed exists or not. When the next nozzle to be processed exists (S214:YES), control returns to step S205. When the next nozzle to be processed does not exist (S214:YES), control proceeds to step S215.

In step S215, the pulse supplying unit 206A makes the settings to supply the ejection pulse patters generated by the pulse generator 204A to the electrodes 35 (corresponding to the ejection nozzles) based on the image data and the pulse pattern type determined by the supplying target determination unit 209 for each of the electrodes 35.

Next, in step S216, the pulse generator 204A generates the ejection pulse patterns based on the preparation made in step S204, and the pulse supplying unit 206A supplies the ejection pulse patterns to the electrodes 35 at a predetermined timing based on the settings made in step S215. Then, the pulse supplying process terminates.

According to the second embodiment, since the plurality of ejection pulse patterns whose phases are different from each other are supplied to the adjacent electrodes 35, the timings at which the pressure chambers 10 located adjacently to a target pressure chamber 10 are driven are different from the timing at which the target pressure chamber 10 is driven. Consequently, it becomes possible to sufficiently suppress the effect of the structural crosstalk.

Further, according to the second embodiment, maximum electric power consumption can be reduced. Therefore, space saving and cost reduction of the inkjet printer 101 are attained.

Further, in this embodiment, the timing determination unit 208 determines the timing number (i.e., the number of types of the ejection pulse patterns) that is the minimum number required to suppress the effect of the structural crosstalk. Therefore, according to the embodiment, the structural crosstalk can be effectively suppressed, and the printing speed can be kept at high level.

Third Embodiment

Figure 18:
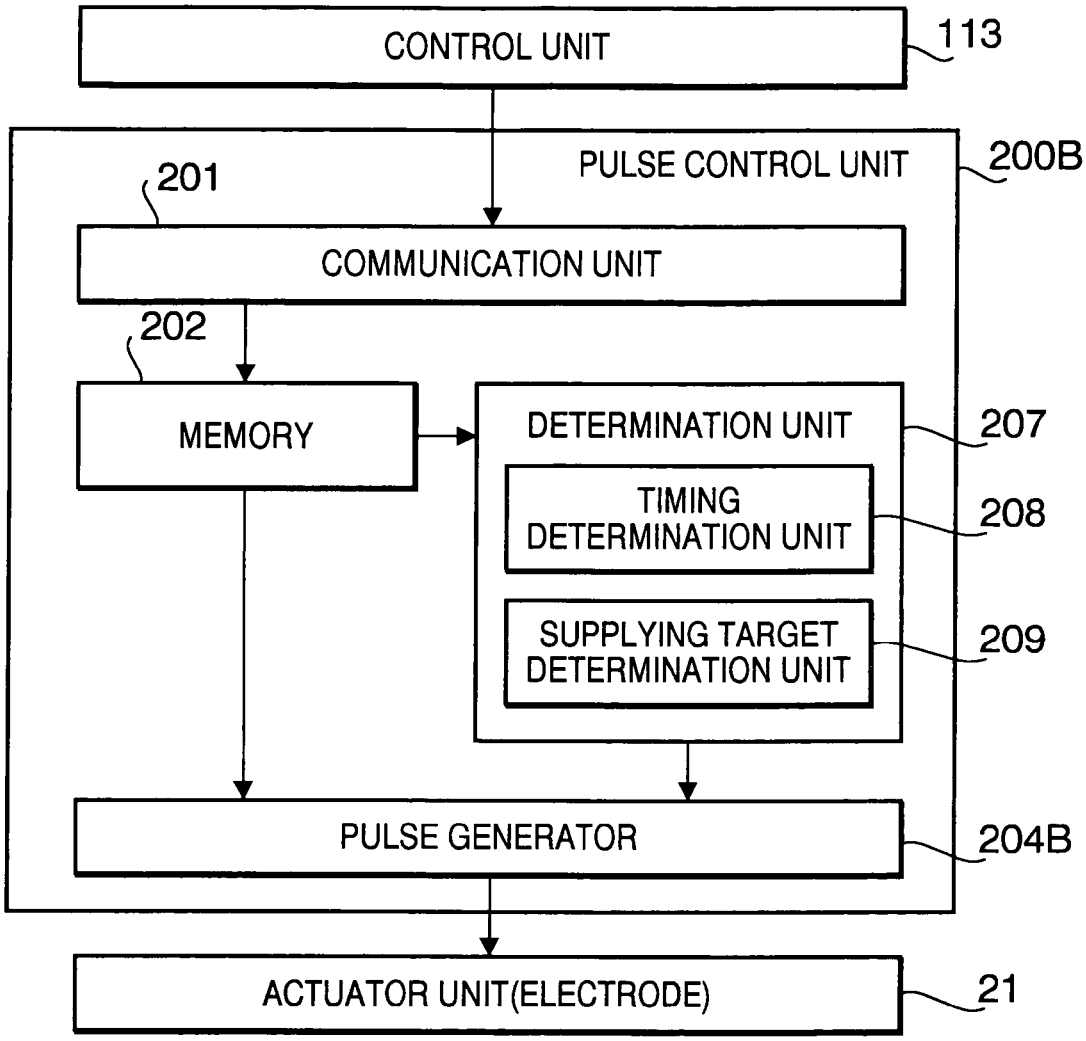
FIG. 18 shows a functional block diagram of a pulse control unit according to a third embodiment.

Next, an inkjet printer according to a third embodiment of the invention will be described. Since in this embodiment only a pulse control unit 200B is different from the pulse control unit 200 of the first embodiment, only the feature of the pulse generator 200B is described. In FIG. 18, to elements which are substantially the same as those of the first embodiment, the same reference numbers are assigned, and the explanations thereof will not be repeated.

FIG. 18 is a functional block diagram of the pulse control unit 200B according to the third embodiment. The pulse control unit 200B has the communication unit 201, the memory 202, a pulse generator 204B, and the determination unit 207.

Hereafter, the pulse control unit 200B that is constituted by the drive IC 80 and the printed circuit board 81 will be explained. Since the functions of the communication unit 201 and the memory 202 are the same as those of the first embodiment, and the function of the determination unit 207 are the same as that of the second embodiment, explanations thereof will not be repeated.

The pulse generator 204B generates, for each of the gray scales, at least two types of ejection pulse patterns having different phases to supply them to the electrodes 35 corresponding to the ejection nozzles. More specifically, the pulse generator 204B generates the ejection pulse pattern for each of the electrodes 35 based on the timing number (i.e., the number of types of the ejection pulse patterns) determined by the determination unit 207 and the pulse pattern type to be assigned to the electrode 35 determined by the supplying target determination unit 209.

The ejection pulse patterns generated by the pulse generator 204B are supplied to electrodes 35 corresponding to the ejection nozzles.

According to the third embodiment, since the plurality of ejection pulse patterns whose phases are different from each other are supplied to the adjacent electrodes 35, the timings at which the pressure chambers 10 located adjacently to a target pressure chamber 10 are driven are different from the timing at which the target pressure chamber 10 is driven. Consequently, it becomes possible to sufficiently suppress the effect of the structural crosstalk.

Further, according to the third embodiment, maximum electric power consumption can be reduced. Therefore, space saving and cost reduction of the inkjet printer 101 are attained.

Although the present invention has been described in considerable detail with reference to certain preferred embodiments thereof, other embodiments are possible.

For example, although in the above mentioned embodiments each of the pressure chambers 10 and the electrodes 35 has a form of a parallelogram, each of the pressure chambers 10 and the electrodes 35 may be configured to have another shape, for example, a rectangular shape.

Although in the above mentioned embodiments the pressure chambers 10 and the electrodes 35 are arranged in a staggered arrangement, the pressure chambers 10 and the electrodes 35 may be arranged in another way. For example, the pressure chambers 10 and the electrodes 35 may be arranged in a grid pattern.

In the first embodiment, one predetermined supplying pattern is used to supply the ejection pulse patterns to the electrodes. However, the pulse control unit may be configured such that a supplying pattern is determined each time the image data is stored in the memory 202. Further, two or more supplying patterns may be used to supply the ejection pulse patterns to the electrodes 35.

In the above mentioned embodiments, the ejection pulse patterns having different phases are assigned to adjacent electrodes 35. Alternatively or additionally, the ejection pulse patterns whose phases are different from the phase of the ejection pulse pattern of a target electrode 35 may be supplied to the electrodes 35 which are not adjacent to the target electrode 35 but are affected by the structural crosstalk.

In the above mentioned second and third embodiments, the timing number (i.e., the number of types of the ejection pulse patterns) is determined by the timing determination unit 208 each time the image data is stored in the memory 202. However, a fixed timing number may be used to generate the ejection pulse patterns.

In the above mentioned embodiments, the phase of the ejection pulse pattern is changed considering a positional relationship between the pressure chambers 10. However, the phase of the ejection pulse pattern may be changed considering a positional relationship between communication channels (i.e., outlets) that connect the pressure chambers 10 to the sub-manifolds 5*a*. In this case, the structural crosstalk transmitted fluidically can be suppressed.

In the above mentioned embodiments, the plurality of ejection pulse patterns having different phases are overlapped with each other temporally. However, the plurality of ejection pulse patterns having different phases may be configured not to overlap with each other temporally. That is, a time period that one ejection pulse pattern occupies may be set not to overlap with a time period that another ejection pulse pattern occupies.

The device and method according to the present invention can be realized when appropriate programs are provided and executed by a computer. Such programs may be stored in recording medium such as a flexible disk. CD-ROM, memory cards and the like and distributed. Alternatively or optionally, such programs can be distributed through networks such as the Internet.

The present disclosure relates to the subject matter contained in Japanese Patent Application No. 2003-293540, filed on Aug. 14, 2003, which is expressly incorporated herein by reference in its entirety.

What is claimed is:

1. An inkjet head printing device, comprising:

an inkjet head that has an ink flow channel unit including a plurality of nozzles for ejecting ink and a plurality of pressure chambers respectively provided for the plurality of nozzles, and a piezoelectric actuator unit including a plurality of electrodes which are provided to apply pressure by using an piezoelectric effect to their respective pressure chambers to eject ink from the respective ones of the plurality of nozzles; and a pulse controller that generates a plurality of types of ejection pulse patterns having different phases, and drives the plurality of electrodes corresponding to the plurality of nozzles which are to eject the ink using the plurality of types of ejection pulse patterns, wherein each of the plurality of types of ejection pulse patterns has a first pulse part and a pulse train part; first pulse parts of the plurality of types of ejection pulse patterns have different pulse lengths; and pulse train parts of the plurality of types of ejection pulse patterns have different phases and same shapes, wherein the pulse controller drives the plurality of electrodes corresponding to the plurality of nozzles which are to eject the ink so that when a certain electrode of the plurality of electrodes corresponding to a certain pressure chamber of the plurality of pressure chambers is supplied with a first ejection pulse pattern of the plurality of types of ejection pulse patterns, at least one of neighboring electrodes corresponding to neighboring pressure chambers adjacent to the certain pressure chamber is supplied with one of the plurality of types of ejection pulse patterns different from the first ejection pulse pattern, wherein:

each of the pressure chambers has a rhombic shape, and each of the electrodes has a rhombic shaped portion and a secondary portion that extends from an acute angle corner of the rhombic shaped portion, at tip of the secondary portion a circular region is formed next to the electrode, the pressure chambers are arranged in a staggered arrangement, and the electrodes are also arranged in a staggered arrangement that corresponds to the staggered arrangement of the pressure chambers;

in the arrangement of the pressure chambers, the pressure chambers are aligned in a line in a first direction and are aligned in a line in a second direction;

in the arrangement of the electrodes, the electrodes are aligned in a line in the first direction and are aligned in a line in the second direction; and neighboring electrodes in at least the second direction are supplied with different ones of the plurality of types of the ejection pulse patterns, respectively.

2. The inkjet head printing device according to claim 1, wherein an electrode of the neighboring electrodes corresponding to a pressure chamber of the neighboring pressure chambers located adjacently to the certain pressure chamber in the first direction of an arrangement of the plurality of pressure chambers is supplied with one of the plurality of types of ejection pulse patterns different from the first ejection pulse pattern.

3. The inkjet head printing device according to claim 2, wherein an electrode of the neighboring electrodes corresponding to a pressure chamber of the neighboring pressure chambers located adjacently to the certain pressure chamber in the second direction of the arrangement of the plurality of pressure chambers different from the first direction is supplied with one of the plurality of types of ejection pulse patterns different from the first ejection pulse pattern.

4. The inkjet head printing device according to claim 1, wherein the plurality of pressure chambers are arranged in a plane to have a plurality rows, each of which has pressure chambers arranged in a line, wherein electrodes of the plurality of electrodes corresponding to adjacent ones of the plurality of pressure chambers of each of the plurality of rows are supplied with different ones of the plurality of types of the ejection pulse patterns, respectively.

5. The inkjet head printing device according to claim 1, wherein the plurality of pressure chambers are arranged in a plane to have a plurality rows, each of which has pressure chambers arranged in a line, wherein one of the plurality of types of the ejection pulse patterns supplied to electrodes of the plurality of electrodes corresponding to the pressure chambers of one of the plurality of rows is different from one of the plurality of types of the ejection pulse patterns supplied to electrodes of the plurality of electrodes corresponding to the pressure chambers of another one of the plurality of rows adjacent to the one of the plurality of rows.

6. The inkjet head printing device according to claim 1, wherein the pulse controller drives the plurality of electrodes so that all of the neighboring electrodes corresponding to the neighboring pressure chambers adjacent to the certain pressure chamber are supplied at least one of the plurality of types of ejection pulse patterns different from the first ejection pulse pattern supplied to the certain electrode corresponding to the certain pressure chamber.

7. The inkjet head printing device according to claim 1, wherein the pulse controller includes:

a pulse generator that generates the plurality of types of ejection pulse patterns based on image data; and a pulse supplying system that assigns the plurality of types of ejection pulse patterns to the plurality of electrodes to drive the plurality of electrodes.

8. The inkjet head printing device according to claim 7, wherein the plurality of types of ejection pulse patterns generated by the pulse generator includes at least three types of ejection pulse patterns.

9. The inkjet head printing device according to claim 8, wherein the pulse supplying system assigns the at least three types of ejection pulse patterns to the plurality of electrodes in the staggered arrangement.

10. The inkjet head printing device according to claim 8, wherein the pulse supplying system assigns a first, second and third ejection pulse patterns of the at least three types of ejection pulse patterns to the plurality of electrodes in this order in one direction of an arrangement of the plurality of electrodes.

11. The inkjet head printing device according to claim 7, wherein the plurality of types of ejection pulse patterns generated by the pulse generator includes at least four types of ejection pulse patterns.

12. The inkjet head printing device according to claim 11, wherein the pulse supplying system assigns the plurality of types of ejection pulse patterns to the plurality of electrodes such that electrodes located adjacently to a first electrode in a direction of a line passing through obtuse angle portions of the rhombic shape of the first electrode are assigned ejection pulse patterns of the four types of ejection pulse patterns different from one of the four types of ejection pulse patterns assigned to the first electrode, and that electrodes located adjacently to the first electrode in a direction of a line passing through acute angle portions of the rhombic shape of the first electrode are assigned ejection pulse patterns of the four types of ejection pulse patterns different from one of the four types of ejection pulse patterns assigned to the first electrode.

13. The inkjet head printing device according to claim 7, wherein the pulse supplying system includes a timing determination unit that determines a number of types of ejection pulse patterns, wherein the pulse generator generates different types of the ejection pulse patterns by the number of types of ejection pulse patterns determined by the timing determination unit.

14. The inkjet head printing device according to claim 13, wherein the timing determination unit determines the number of types of ejection pulse patterns in accordance with a number of nozzles which are to eject the ink with respect to a number of all of the plurality of nozzles.

15. The inkjet head printing device according to claim 7, wherein the pulse supplying system assigns the plurality of types of ejection pulse patterns to the plurality of electrodes using a supplying pattern representing a correspondence between the plurality of electrodes and the plurality of types of ejection pulse patterns.

16. The inkjet head printing device according to claim 15, wherein the supplying pattern is predetermined, wherein the pulse supplying system uses the predetermined supplying pattern.

17. The inkjet head printing device according to claim 15, wherein the pulse supplying system includes a supplying pattern determination unit that determines the supplying pattern based on the image data and a number of types of the plurality of types of ejection pulse patterns.

18. The inkjet head printing device according to claim 1, wherein the pulse controller includes:

a determination unit that determines a number of types of ejection pulse patterns included in the plurality of types of ejection pulse patterns, and determines which type of the plurality of types of ejection pulse patterns is supplied to each of the plurality of electrodes; and a pulse generator that generates the plurality of types of ejection pulse patterns to drive the plurality of electrodes in accordance with a determination result of the determination unit.

19. The inkjet head printing device according to claim 1, wherein the ink flow channel unit includes a common manifold, the plurality of pressure chambers communicate with the common manifold via respective outlets, wherein the pulse controller drives the plurality of electrodes corresponding to the plurality of nozzles which are to eject the ink so that when a certain electrode of the plurality of electrodes corresponding to a certain outlet of a certain pressure chamber of the plurality of pressure chambers is supplied with a first ejection pulse pattern of the plurality of types of ejection pulse patterns, at least one of neighboring electrodes corresponding to pressure chambers communicating with neighboring outlets adjacent to the certain outlet of the certain pressure chamber is supplied with one of the plurality of types of ejection pulse patterns different from the first ejection pulse pattern.

20. The inkjet head printing device according to claim 19, wherein all of the neighboring electrodes are supplied with the plurality of types of ejection pulse patterns different from the first ejection pulse pattern.

* * * * *